US010641078B2

(12) United States Patent
Thomas et al.

(10) Patent No.: US 10,641,078 B2
(45) Date of Patent: May 5, 2020

(54) INTELLIGENT CONTROL OF DRILL PIPE TORQUE

(71) Applicant: Wellbore Integrity Solutions LLC, Houston, TX (US)

(72) Inventors: John Allen Thomas, Porter, TX (US); Vineet V. Nair, The Woodlands, TX (US); Rohan V. Neelgund, Houston, TX (US); Fei Li, Spring, TX (US); Gerre S. Voden, Jr., Oklahoma City, OK (US); Sneha Deshpande, Cypress, TX (US)

(73) Assignee: Wellbore Integrity Solutions LLC, Houston, TX (US)

( * ) Notice: Subject to any disclaimer, the term of this patent is extended or adjusted under 35 U.S.C. 154(b) by 633 days.

(21) Appl. No.: 15/219,704

(22) Filed: Jul. 26, 2016

(65) Prior Publication Data

US 2017/0030181 A1 Feb. 2, 2017

Related U.S. Application Data

(60) Provisional application No. 62/198,273, filed on Jul. 29, 2015.

(51) Int. Cl.

| | |
|---|---|
| ***E21B 44/02*** | (2006.01) |
| ***E21B 44/04*** | (2006.01) |
| ***E21B 47/06*** | (2012.01) |
| ***E21B 19/16*** | (2006.01) |
| ***E21B 44/00*** | (2006.01) |
| ***E21B 10/26*** | (2006.01) |

(52) U.S. Cl.
CPC ..... *E21B 44/04* (2013.01); *E21B 10/26* (2013.01); *E21B 19/16* (2013.01); *E21B 44/00* (2013.01); *E21B 47/06* (2013.01); *E21B 19/166* (2013.01)

(58) Field of Classification Search
CPC ..... E21B 44/04; E21B 44/00; E21B 47/06; E21B 19/166; E21B 19/16; E21B 10/26
See application file for complete search history.

(56) References Cited

U.S. PATENT DOCUMENTS

| | | | |
|---|---|---|---|
| 6,776,070 | B1 | 8/2004 | Mason et al. |
| 7,159,654 | B2 | 1/2007 | Ellison et al. |
| 7,946,356 | B2 | 5/2011 | Koederitz et al. |
| 7,958,787 | B2 | 6/2011 | Hunter |
| 8,016,037 | B2 | 9/2011 | Bloom et al. |

(Continued)

OTHER PUBLICATIONS

Smith International, Inc., "Tru-Torque(R) Automatic Torque Control System," Tubular and Tubular Services [9], 2008, p. 19, Houston, Texas.

*Primary Examiner* — Yong-Suk Ro
(74) *Attorney, Agent, or Firm* — Hubbard Johnston, PLLC

(57) ABSTRACT

Tools and method for automatically controlling torque when making-up and/or breaking-down threaded connections between downhole assets such as drill pipe, drill collars, and BAH components. An iron roughneck may be controlled by, for instance, automatically monitoring and adjusting the fluid pressure of cylinders that ultimately provide the torque to the downhole assets. The torque may further be automatically controlled by automatically identifying the downhole assets and selecting a corresponding torque profile or target torque. Clamping force may also be controlled, and is optionally proportional to the target torque.

17 Claims, 14 Drawing Sheets

(56) References Cited

U.S. PATENT DOCUMENTS

| | | | | |
|---|---|---|---|---|
| 8,074,537 | B2 | 12/2011 | Hunter | |
| 8,387,720 | B1 | 3/2013 | Keast et al. | |
| 8,590,401 | B2 | 11/2013 | Conquergood et al. | |
| 8,601,910 | B2 | 12/2013 | Begnaud | |
| 9,027,416 | B2 | 5/2015 | Conquergood et al. | |
| 9,249,655 | B1 * | 2/2016 | Keast | E21B 3/02 |
| 2005/0067173 | A1 | 3/2005 | Green | |
| 2013/0090855 | A1 * | 4/2013 | Rasmus | E21B 47/06 702/9 |
| 2014/0299376 | A1 | 10/2014 | Bertelsen | |
| 2016/0138382 | A1 * | 5/2016 | Badkoubeh | E21B 44/04 175/24 |
| 2016/0245067 | A1 * | 8/2016 | Haci | E21B 47/02 |
| 2016/0342916 | A1 | 11/2016 | Arceneaux et al. | |
| 2017/0306702 | A1 * | 10/2017 | Summers | E21B 44/02 |

* cited by examiner 641-2

WELLSITE TUBULAR MANAGEMENT

Well: Bakken X2AD6

Tubular ID: #93586924

4.989" OD
0.343" wall thickness
NC50 Tool Joint
6.621" OD
3.52" ID

History:

01/31/2015 11:14:33: Delivery to X2AD6
02/15/2015 08:21:27: Make-up and trip into well
02/22/2015 16:03:41: Trip out of well and decouple
02/28/2015 18:57:06: Send to Drilco Broussard
03/02/2015 06:36:31: Received by Drilco Broussard
03/03/2015 10:16:06: Inspection Complete

*FIG. 6-3*

642

TUBULAR INSPECTION

Tubular ID: #93586924

Pipe ID: _____
Pipe OD: _____
Tool Joint ID: _____
Tool Joint OD: _____
Cracks: _____
Pitting: _____
Ultrasonic Data: (attach)
X-ray Data: (attach)
Hardbanding condition: _____

*FIG. 6-4*

INTELLIGENT CONTROL OF DRILL PIPE TORQUE

CROSS-REFERENCE TO RELATED APPLICATIONS

This application claims the benefit of, and priority to, U.S. Patent Application Ser. No. 62/198,273, filed on Jul. 29, 2016. This application is also related to U.S. Patent Application Ser. No 62/164,448, filed on May 20, 2015 and to U.S. patent application Ser. No. 15/158,096, filed on May 18, 2016. Each of the foregoing applications is expressly incorporated herein by this reference in its entirety.

BACKGROUND

In the course of drilling and completing oil and gas wells, oil production companies use and install hundreds or even thousands of downhole tools. Example downhole tools include tubulars (e.g., drill pipe), drill bits, mud motors, reamers, jars, stabilizers, mills, etc. When used in the downhole environment, the various downhole tools may be damaged or worn.

Damage to the downhole tools may be the result of conditions in the wellbore or on the surface. For instance, contact between the formation or casing and the downhole tool may cause wear or pitting on the outer surfaces of the downhole tools. Drilling fluid flowing through the drill pipe may cause similar wear or pitting on the internal surfaces of the downhole tools. During make-up of tool strings at surface, devices used to apply torque to the tool joints may over-torque the tools, thereby damaging the threaded connections.

SUMMARY

A torque control system includes a processor, fluid pressure sensors, and torque sensors. Computer-readable media stored by the torque control system includes computer-executable instructions which, when executed by the one or more processors, automatically controls torque of a torque application device. Control may be performed by adjusting fluid pressure, and the fluid pressure sensors may provide feedback on the pressure, while the torque sensors may provide feedback on the resultant torque.

An example method for automatically controlling torque applied to connect downhole assets may include measuring fluid pressure to one or more cylinders of a torque application device. Fluid pressure of the one or more cylinders may be automatically adjusted based on a target torque, and a force applied by the torque application device to a downhole asset may be measured to directly or indirectly determine the torque on the downhole asset. Fluid pressure may be reduced when the determined torque on the downhole asset reaches the target torque.

In some embodiments, a method for controlling torque and clamping force on connections of downhole assets includes determining a torque arm of a downhole asset by identifying a diameter or width of the downhole asset. A torque profile associated with the downhole asset is identified, including a target torque. Torque is applied to the downhole asset according to the torque profile and up to the target torque. Applying torque includes controlling fluid pressure to one or more cylinders of a torque application device and thereby controlling clamping force on, and rotation of, the downhole asset. The torque is dependent on the determined torque arm, and the clamping force varies proportionally with the applied torque. The fluid pressure of the one or more cylinders is reduced when the applied torque on the downhole asset reaches the target torque. Optionally, the health of the downhole asset may also be monitored in real-time.

This summary is provided to introduce some features and concepts that are further developed in the detailed description. Other features and aspects of the present disclosure will become apparent to those persons having ordinary skill in the art through consideration of the ensuing description, the accompanying drawings, and the appended claims. This summary is therefore not intended to identify key or essential features of the claimed subject matter, nor is it intended to be used as an aid in limiting the scope of the claims

BRIEF DESCRIPTION OF DRAWINGS

Various specific embodiments are provided in the drawings appended hereto in order to facilitate a description of some aspects of the present disclosure. These drawings depict just some example embodiments and are not to be considered to be limiting in scope of the present disclosure.

FIG. 1-2 schematically illustrates an example control unit for a wellsite, according to some embodiments of the present disclosure;

FIG. 2 is a side view of an example drill pipe, according to some embodiments of the present disclosure;

FIGS. 6-1 to 6-8 depict example user interfaces of a tubular management system, according to some embodiments of the present disclosure;

FIGS. 7-1 to 7-4 illustrate graphical representations of tubular histories, according to some embodiments of the present disclosure;

FIG. 8 is a flow chart of a method for developing a tubular wear model, according to some embodiments of the present disclosure.

DETAILED DESCRIPTION

In accordance with some aspects of the present disclosure, embodiments herein relate to downhole tools. More particularly, some embodiments disclosed herein may relate to systems for managing downhole tools. Example downhole tools may include drill bits, mills, reamers, drill pipe and other tubulars, stabilizers, debris catchers, jars, downhole motors, and the like. Systems that manage the downhole tools may be used to track various types of information about the downhole tools, control parameters associated with downhole tools, or combinations of the foregoing. Example information may include, but is not limited to, tool location, tool condition, tool inspection history, tool maintenance history, tool usage (e.g., where used, when used, what jobs performed, time downhole make-up torque, mud type flowing through the tool, etc.). Example parameters associated with downhole tools may include make-up torque, make-up time, break-out torque, break-out time, fluid type, fluid pressure, fluid flow rate, and the like.

Figure 1:
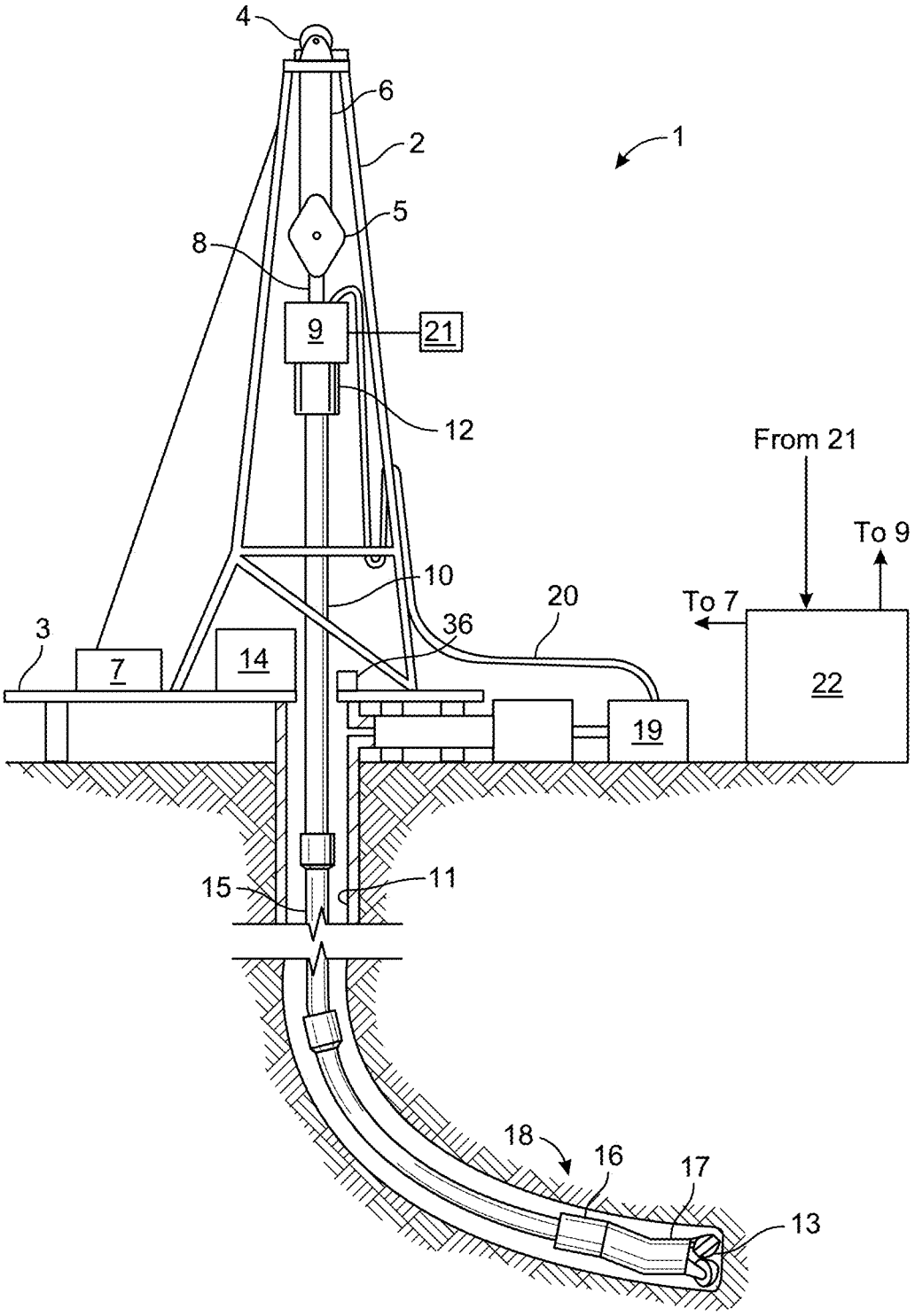
FIG. 1-1 illustrates an example wellsite, according to some embodiments of the present disclosure.

In FIG. 1-1, a drilling unit, drilling rig, or wellsite is designated generally at 1. The wellsite 1 in FIG. 1-1 is shown as a land-based drilling rig; however, as will be apparent to those skilled in the art in view of the disclosure herein, the examples described herein will find equal application on marine drilling rigs, such as jack-up rigs, semi-submersibles, drill ships, and the like.

The illustrated wellsite 1 includes a derrick 2 that is supported on the ground above a rig floor 3. The wellsite 1 may include lifting gear, such as a crown block 4 mounted to the derrick 2 and a traveling block 5. The crown block 4 and the traveling block 5 are shown as being interconnected by a cable 6 that is driven by a draw works 7 to control the upward and downward movement of the traveling block 5. The draw works 7 may be configured to be automatically operated to control a rate of drop or release of a drill string into a wellbore during drilling.

The traveling block 5 may carry a hook 8 from which is suspended a top drive 9. The top drive 9 supports a drill string 10 in a wellbore 11. According to some example implementations, the drill string 10 may be in signal communication with and mechanically coupled to the top drive 9, such as through an instrumented sub 12. The instrumented top sub 12 or other system or device may include sensors (e.g., downhole or surface sensors) that provide drill string torque information. Other types of torque sensors may be used in other examples, or proxy measurements for torque applied to the drill string 10 by the top drive 9 may be used, non-limiting examples of which may include electric current (or related measure corresponding to power or energy) or hydraulic fluid flow drawn by a motor in the top drive 9. A longitudinal end of the drill string 10 may include a downhole tool 13 (e.g., a drill bit, reamer, perforating gun, mill, cementing tool, etc.) for performing a downhole operation. Example downhole operations may include, for instance, drilling formation, milling casing around a wellbore, perforating casing, completions operations, other downhole operations, or combinations of the foregoing.

The top drive 5 can be operated to rotate the drill string 10 in either direction. A load sensor (not shown) may be coupled to the hook 8 in order to measure the weight load on the hook 8. Such weight load may be related to the weight of the drill string 10, friction between the drill string 10 and the wellbore 11 wall, and an amount of the weight of the drill string 10 that is applied to the downhole tool 13 to perform the downhole operation (e.g., drilling the formation to extend the wellbore 11).

The drill string 10 may include coiled tubing, a wireline, or segments of interconnected drill pipes 15 (e.g., drill pipe, drill collars, transition or heavy weight drill pipe, etc.). Where the drill string includes segmented tubulars, a make-up device 14 may be used to connect a tool joint of one tubular to a tool joint of another tubular. For instance, the make-up device 14 may include power tongs or an iron roughneck used to apply torque for connecting a pin connection of one tubular with a box connection of a mating tubular. The make-up device 14 may also be used to break down connections when tripping the drill string 10 out of the wellbore 11.

In some embodiments, an identification sensor 36 may be used to track components of the drill string 10 that are tripped into and out of the wellbore 11. The identification sensor 36 may be located on the rig floor 3 (e.g., near the rotary table), positioned on or near the make-up device, located on or near the top drive 9, or at various other locations. For instance, the identification sensor 36 may be located in, on, or near a catwalk, v-door, pipe stand, pipe elevator, monkeyboard, kelly, bale, rathole, pipe deck, pipe rack, pipe storage area, blow-out-preventer, slips, stabbing guides, hydril, bell nipple, rotating head, setback, doghouse, casing running equipment, draw works 7, control unit 22, mud pump 19, wellhead, casing, or any of various other locations or equipment (e.g., any pipe handling, storage, transport, or sequencing location or equipment, below or above a rotary table, etc.). In some embodiments, the identification sensor 36 may be incorporated into a movable device such as a handheld reader, or even wearable (e.g., on clothing of an operator at the wellsite 1, incorporated into goggles or eyewear, etc.).

According to some embodiments, the identification sensor 36 may be used to identify the components at or near the rotary table. For instance, as a drill pipe of the drill string 10 is tripped into the wellbore 11, the identification sensor 36 may detect (either automatically or with input from an operator) the serial number, identification, or other information relative to the component. As discussed in more detail herein, this information may allow for management of data related to individual components. Accordingly, identifying a component as it goes into a well (and is pulled from the well) allows information such as the date/time of use in a well, the duration of use in a well, the depth of the component within the well, the torque applied by the make-up device 14, the total rotating or operating time of a component within a well, the type of drilling fluid(s) used with a component, the other components coupled to the monitored component, other information, and combinations of the foregoing, to be associated directly with the monitored component.

The identification sensor 36 may operate in any suitable manner. For instance, the identification sensor 36 may include an optical sensor that scans the drill pipe or other downhole component to find and read a serial number. The identification sensor 36 may be an RFID reader that reads an RFID tag on the downhole component. The RFID tag may be a passive tag or an active tag. Where the RFID tag is an active tag, the identification sensor 36 may also be used to write information to the RFID tag. For instance, information about the use of the pipe (date/time detected, adjacent drill string components, make-up torque applied, etc.) may be written to the tag. Where the RFID tag is passive, similar information may be stored in a local or remote data store and associated with the component (or an identifier corresponding to the RFID tag or associated component). In other embodiments, Bluetooth, RuBee, Memory Spot, or other electromagnetic sensor devices or wireless devices may be used to read, write, or both read and write data to corresponding tags or elements of a downhole component.

The drill string 10 may also include other components such as stabilizers, measurement-while-drilling (MWD) instruments, logging-while-drilling (LWD) instruments, jars, vibrational tools, downhole motors, other components, or combinations of the foregoing (collectively designated 16). These components 16 may be tracked or monitored in a manner similar to drill pipe or other components of the drill string 10. In some embodiments, a motor 17 (e.g., a steerable drilling motor) may be connected proximate the bottom of a bottom-hole assembly (BAH) 18. The motor 17 may be any type known in the art for rotating the downhole tool 13, selected portions of the drill string 10, or combinations of the foregoing. The motor 17 may be used to enable changes in trajectory of the wellbore 11 during slide drilling or to perform rotary drilling. Example types of motors include, without limitation, fluid-operated positive displacement or turbine motors, electric motors, and hydraulic fluid operated motors. For a motor operated by fluid, drilling fluid may be delivered to the drill string 10 by mud pumps 19 through a mud hose 20. In some examples, pressure of the drilling mud may be measured by a pressure sensor 21. During a downhole operation, the drill string 10 may be rotated within the wellbore 11 by the top drive 9 (which may be mounted on parallel, vertically extending rails to resist rotation as torque is applied to the drill string 10). During the operation, the downhole tool 13 may be rotated by the motor 17, which in the present example may be operated by the flow of drilling fluid supplied by the mud pumps 19. Although a top drive rig is illustrated, those skilled in the art will recognize that the present example may also be used in connection with systems in which a rotary table and kelly are used to apply torque to the drill string 10. Cuttings and swarf produced as during the downhole operation may be carried out of the wellbore 11.

Signals from the pressure sensor 21, the hookload sensor, the instrumented sub 12, the BAH 18 (e.g., an MWD/LWD system, motor 17, etc.), or other components (which may be communicated using any known surface-to-surface or wellbore-to-surface communication system), may be received in a control unit 22.

Figures 1, 2:
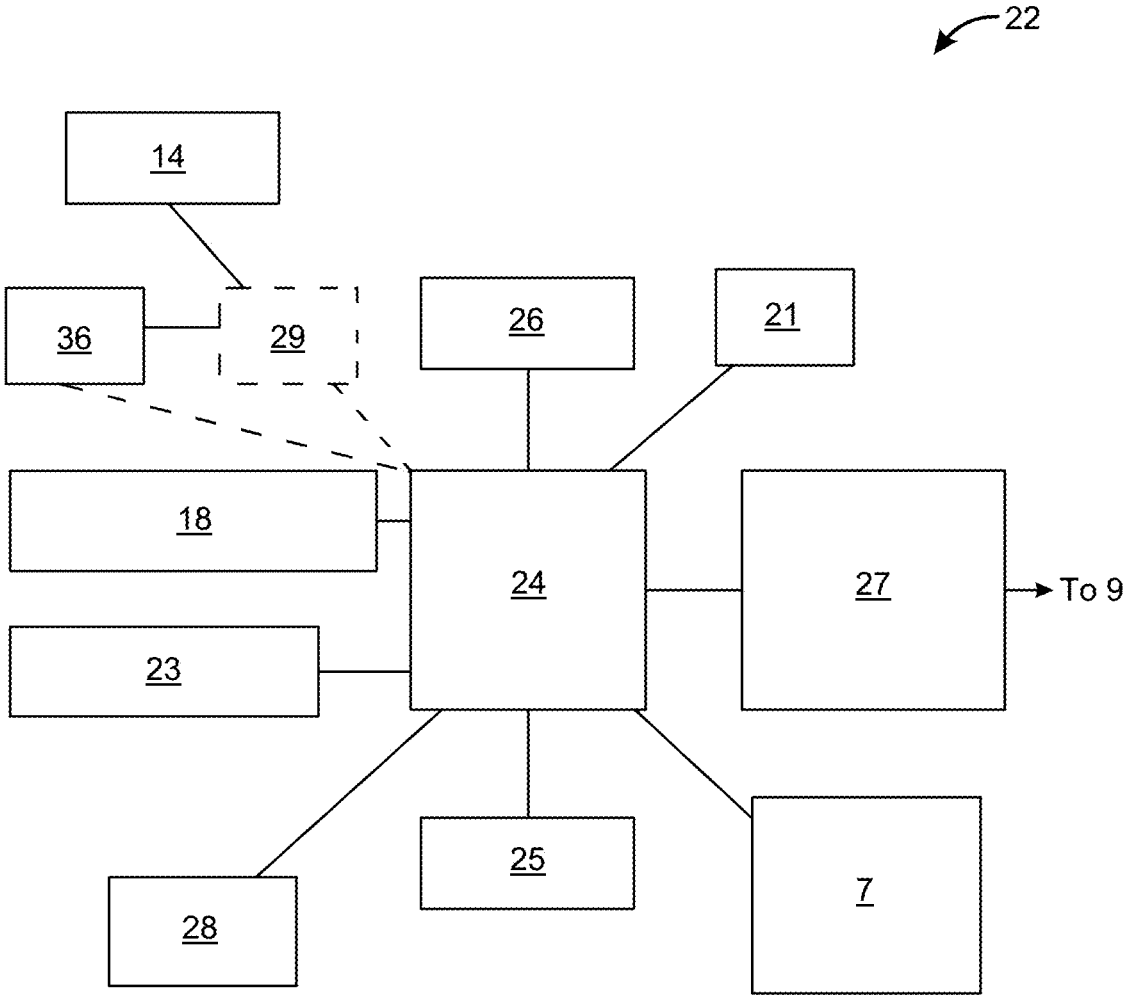
Figure 2:
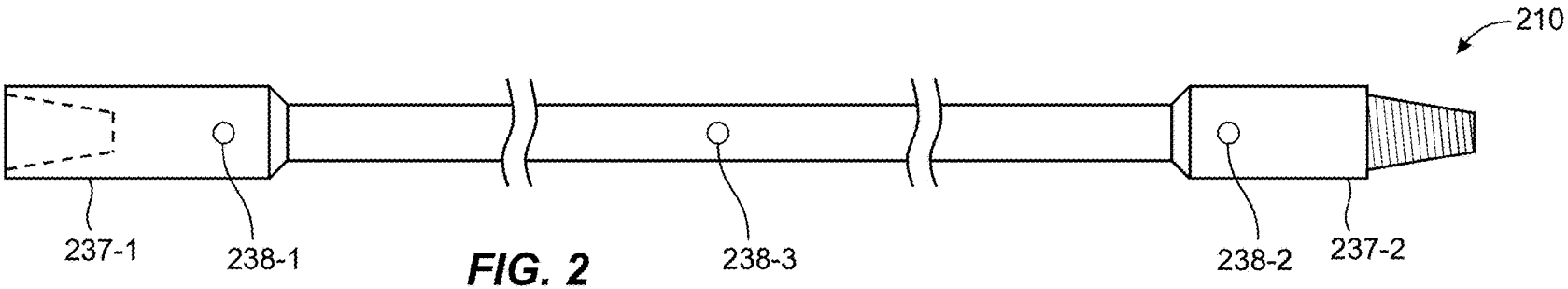

FIG. 1-2 shows a block diagram of the functional components of an example of the control unit 22. The control unit 22 may include a drill string rotation control system. Such system may include a torque related parameter sensor 23. The torque related parameter sensor 23 may provide a measure of the torque (or related measurement) applied to the drill string (10 in FIG. 1-1) at the surface by the top drive or kelly. The torque related parameter sensor 23 may be implemented, for example, as a strain gage in the instrumented sub (12 in FIG. 1-1) if it is configured to measure torque. In principle, the torque related parameter sensor 23 may be any sensor that measures a parameter that can be directly or indirectly related to the amount of torque applied to the drill string.

The output of the torque related parameter sensor 23 may be received as input to a processor 24. In some examples, output of the pressure sensor 21 or one or more sensors of the BAH 18 may also be provided as input to the processor 24. The processor 24 may be any programmable general purpose processor such as a programmable logic controller (PLC) or may be one or more general purpose programmable computers. The processor 24 may receive user input from user input devices 25, such as a keyboard, touch screen, keypad, mouse, microphone, and the like. The processor 24 may also provide visual output to an output device 26, such as a display, speaker, or printer. The processor 24 may also provide output to a drill string rotation controller 27 that operates a top drive (7 in FIG. 1-1) or rotary table to rotate the drill string. The drill string rotation controller 27 may be implemented, for example, as a servo panel that attaches to a manual control panel for the top drive, as a direct control to the top drive motor power input (e.g., as electric current controls or variable orifice hydraulic valves), as computer code in the control unit 22 to operate the top drive (or a top drive controller), or in other manners. The processor 24 may also accept as input signals from the hookload sensor 28. The processor 24 may also provide output signals to the automated draw works 7. During a full or partial portion of the downhole operation, the control unit 22 may operate the draw works 7 to maintain the pressure measured by the pressure sensor 21 close to a desired value.

According to some examples, the processor 24 may communicate with the make-up device 14 to receive information therefrom, or to send information thereto. For instance, the processor 24 may send control signals to the make-up device 14 to control the amount of make-up torque applied to a drill string connection, to define the torque curve (e.g., rate at which torque is increased to apply the make-up torque), or the like. Similarly, the processor 24 may receive information from the make-up device 14, such as the torque applied, information about the drill string tubulars coupled together (e.g., serial numbers), and the like. Although such information may be communicated between the make-up device 14 and the processor 24, in other embodiments, one or more intermediate devices may be positioned between the processor 24 and the make-up device 14, or a separate device may be used in lieu of the processor 24. For instance, the processor 24 may instruct (or receive information from) a controller 29 that in turn communicates with and sends instructions to, or receives information from, the make-up device 14. In other embodiments, the controller 29 and make-up device 14 may communicate with each other independently of, and without communication with, the processor 24.

In some example embodiments, an identification sensor 36 may be used to detect the presence or use of a downhole component. The identification sensor 36 may be in communication with the controller 29, the processor 24, or both, as shown in FIG. 1-2. For instance, the identification sensor 36 may identify a particular drill pipe, downhole tool, tool joint, or other component. The amount of torque applied by the make-up device to make-up or break-down a connection may be determined and stored (e.g., in an RFID tag, a data store, or the like). In some embodiments, the information obtained by the sensor 36 may be used to determine the amount of torque that should be applied. For instance, the controller 29 or processor 24 may associate the data obtained by the sensor 36 with a particular size or type of downhole tool, and use a data table to determine the recommended amount of torque to be applied to make-up a connection, the allowable clamping force by a make-up device, or the like. The torque and clamping force may then be applied and the controller 29 or processor 24 may then also record and store data indicating that amount of torque was applied during make-up or break-down of the connection. In some embodiments, the identification sensor 36 may detect the size, shape, or material of the downhole component, and then use one or more of such properties—instead of an identification number for the component or type of component—with a data table in order to determine the torque to be applied during make-up or break-down, the clamping force applied to the component, and the like.

Figure 4:
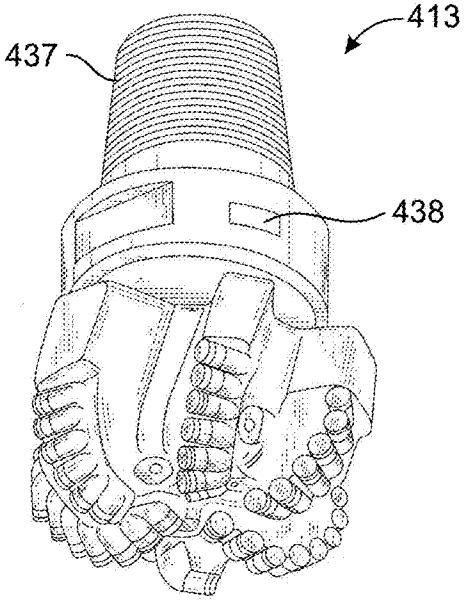
FIG. 4 is a side view of an example downhole tool with fixed cutting structures, according to some embodiments of the present disclosure.
Figure 3:
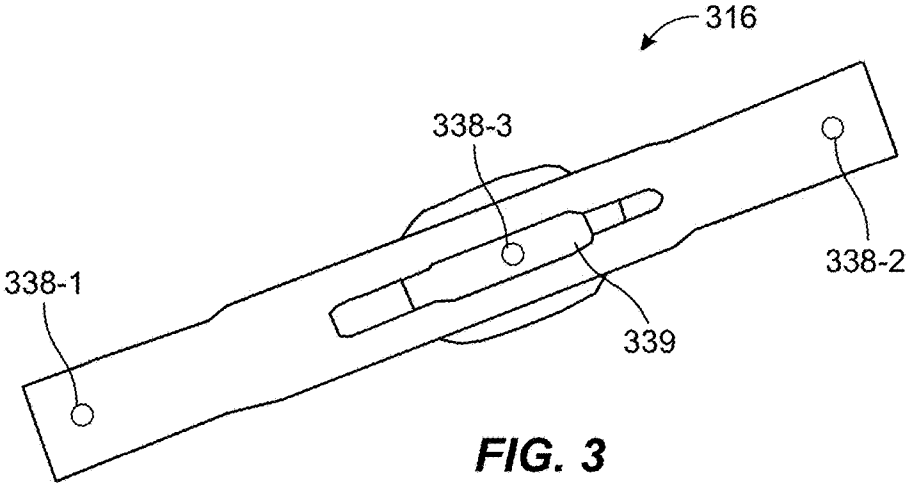
FIG. 3 is a side view of an example expandable downhole tool, according to some embodiments of the present disclosure.

FIGS. 2-4 illustrate examples of components that may be tracked, identified, monitored, or otherwise used in connection with a control unit, identification sensor, controller, processor, other components, or any combination of the foregoing. In particular, FIG. 2 illustrates an example drill pipe 210 including an internally threaded box connection 237-1 and an externally threaded pin connection 237-2. The box connection 237-1 and pin connection 237-2 are examples of tool joints, which may collectively be referred to as tool joints 237. In the illustrated embodiments, the drill pipe 210 may include one or more indicia 238-1, 238-2, 238-3 (collectively indicia 238) that may be used to identify the drill pipe 210, the corresponding tool joint 237, or another portion of the drill pipe 210 (e.g., a central upset). The indicia 238 may have any number of forms. For instance, the indicia 238 may include serial numbers, product numbers (e.g., SKUs), bar codes, or other information. Such information may be stamped, etched, machined, or otherwise formed on the drill pipe 210, or formed on a tag or other member embedded in, attached to, or otherwise coupled to the drill pipe 210. In some embodiments, the indicia 238 may provide information that may not be visible to the naked eye. For instance, a serial or product number may be stored in an electromagnetic form. A handheld, portable, or fixed electromagnetic reader (and optionally writer) may then read the electromagnetic data to identify the drill pipe 210, the type/characteristics of the drill pipe 210, history of the drill pipe 210, or other information. This information may be used or updated as discussed herein. In some embodiments, indicia 238 on a tool joint 237 may be used to specifically identify the corresponding tool joint 227-1 or 237-2, while in other embodiments the indicia 237 on the tool joint 237 may identify the drill pipe 210 as a whole.

While FIG. 2 illustrates an example embodiment in which three indicia 238 are used, in other embodiments there may be more or fewer indicia 238. For instance, there may be a single indicia 238, two indicia 238, four indicia 238, five indicia 238, or more than five indicia 238 on a single component drill pipe 210 or other component.

Similarly, the downhole component 316 (e.g., a reamer, stabilizer, section mill, etc.) of FIG. 3 may include one or more indicia 338-1, 338-2, 338-3 (collectively indicia 338). The indicia 338 may be used to specifically identify the downhole component 316 or any portion thereof For instance, indicia 338-1, 338-2 may specifically identify tool joints or connections (e.g., box connections) of the downhole component 316. The indicia 338-3 may specifically identify an expandable element 339 of the downhole component 316. In some embodiments, the tool joints may be redressed so that information specific to the tool joints can be tracked. The expandable elements 339 may, in some embodiments, be redressed or replaced, to allow information about such expandable elements 339 to also be tracked. While a single indicia 338-3 is shown on an expandable element 339, in other embodiments there may be a different indicia on each expandable element, or some expandable elements 339 may have indicia 338, but others may not. Accordingly, while three indicia 338 are shown, the downhole component 316 may instead have 1, 2, 4, 5, 6, 7, 8, 9, 10, or more indicia 338.

The downhole tool 413 of FIG. 4, which is in the illustrated embodiment a drill bit, may similarly include indicia 438. The indicia 438 may identify the entire downhole tool 413, including any cutting elements, connections 437, blades, or other components thereof. By using the indicia 438, a sensor or other tool may identify the downhole tool 438 to obtain other information, such as the number of times the tool has been made up, the make-up torque applied during connections, information about remedial or repair work on the connection 437 or cutting structure (e.g., what was done, when, where, and by whom), and the like. Any number of indicia 413 may be provided (e.g., one for the connection 437, one for the cutting structure, one for the bit as a whole).

Figure 5:
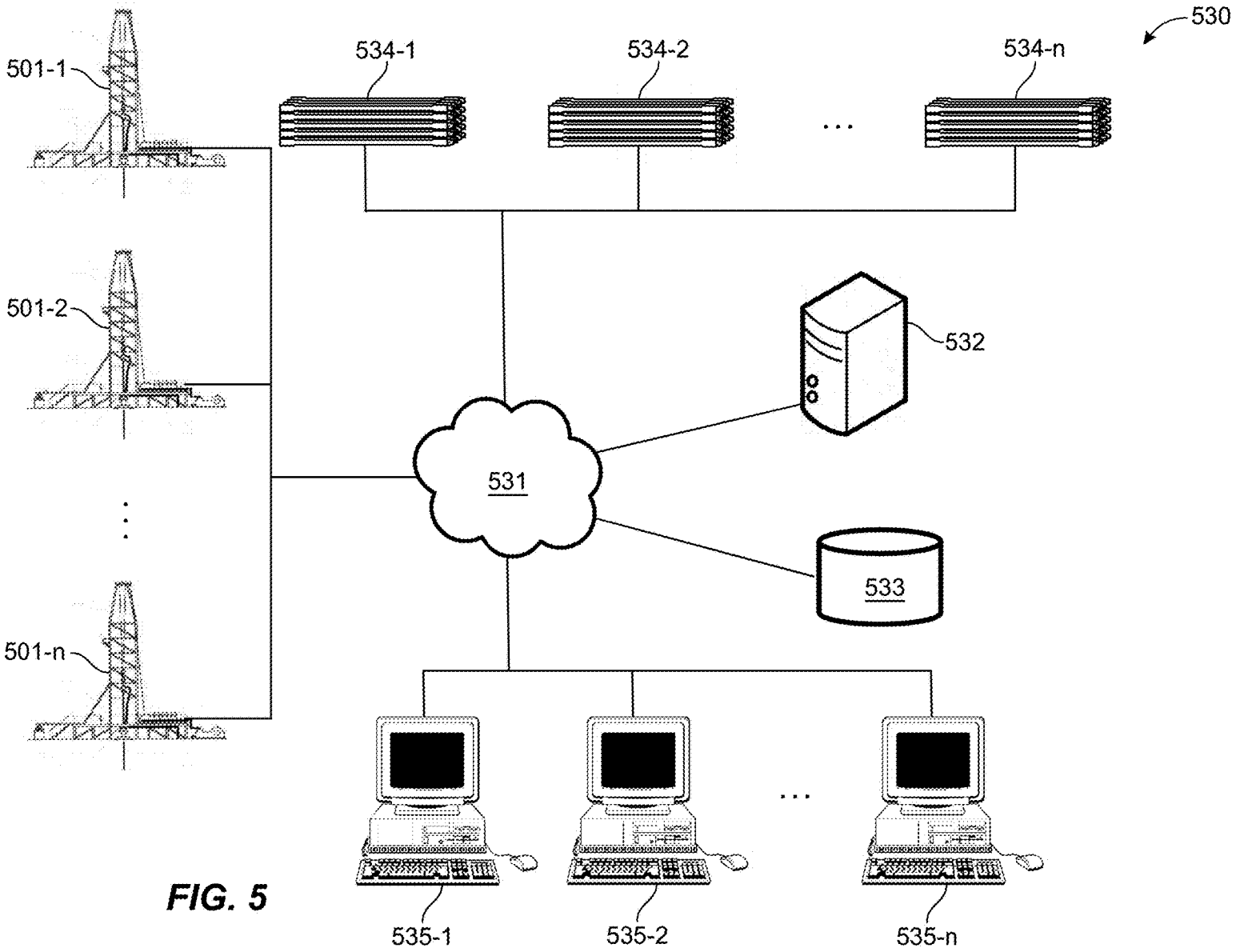
FIG. 5 schematically illustrates a tubular management system, according to some embodiments of the present disclosure.

Referring now to FIG. 5, a schematic diagram is provided of an example system 530 for managing identifiable components used in connection with a downhole system. For simplicity, the system 530 will also be referred to as a tubular management system that may be used to manage drill pipe and other tubular assets; however, the system 530 may be used to manage any number of different downhole tools. Thus, the system 530 should not be interpreted as being limited to use with tubulars, and may similarly be used in the management of other assets such as drill bits, mills, stabilizers, reamers, reamer blocks, jars, motors, other components, or combinations of the foregoing.

The tubular management system 530 may include, in some embodiments, one or more different components that may each communicate with each other for maintaining use, maintenance, inspection, location, transport, or other information about various tubulars or other downhole tools. In FIG. 5, the tubular management system 530 includes a network 531, which may facilitate communication between the various components. As an example, the network 531 may include a local area network (LAN), a wide area network (WAN) such as the Internet, a mobile network, an Intranet, or any other type of network. The network 531 may be used to transfer information, instructions, or other data through a network interface including wires, cables, fibers, optical connectors, wireless connections, network interface connections, rig-site components, rig-remote components, other components, or any combination of the foregoing.

FIG. 3 illustrates various types of components/systems that may communicate with the network 531, although such an embodiment is not an exhaustive listing of the components that may communicate with the network 531, and fewer, other, or additional components may communicate with the network 531 in practice. In particular, FIG. 3 illustrates an example embodiment in which the network 531 may communicate with any of: (i) one or more server components 532; (ii) one or more data stores 533; (iii) one or more rigs or wellsites 501-1, 501-2, 501-n (collectively wellsites 501); (iv) one or more offsite locations 534-1, 534-2, 534-n remote from a rig or wellsite (collectively offsite locations 534); or (v) one or more computing devices 535-1, 535-2, 535-n (collectively computing devices 535). In some embodiments, the offsite locations 534 may include locations that may be used to maintain, remediate, store, re-dress, repair, or inspect tubulars or other downhole tools. In at least some embodiments, the one or more computing devices 535 may be located at a wellsite 501 where a drill string tubular or other downhole tool is used, or at an offsite location 534 where the downhole tool is stored, maintained, inspected, repaired, or the like. In still other embodiments, the computing devices 535 may be at other locations. For instance, an owner of downhole tool assets may use a computing device 535 at a central or other office, at home, or even in the field to access the network 531 to obtain information on downhole tool assets. Example types of data that may be obtained, as discussed herein, may include the location, type, condition, usage/service history, maintenance history, inspection history, repair history, status, or other information about a downhole tool. In further embodiments, the computing device 535 may be used to request information about a downhole tool, to communicate with a wellsite 501, offsite location 534, or other location, to request shipment of a downhole tool, or the like. In some embodiments, information about different downhole tools may be stored in the data store 533. Although shown separately from the server 532, the data store 533 and the server 532 may be combined in some embodiments. Further, multiple servers 532 and/or data stores 533 may be used in some embodiments of the present disclosure. In some embodiments, a computing device 535, data store 533, or server 532 may be located at a wellsite 501, and may interface with a control unit, processor, or controller (e.g., control unit 22 of FIGS. 1-1 and 1-2).

To obtain an understanding of an example manner in which a tubular management system (e.g., tubular management system 530) may be used in accordance with some embodiments of the present disclosure, FIGS. 6-1 to 6-8 illustrate example user interfaces that may be accessed in the tubular management system. The user interfaces may be stored in the form of computer-executable instructions on a server, data store, computing device, or the like, and may access data that is stored locally or remotely. Remotely stored data may be accessed over a communications network or other similar system.

Figures 1, 6:
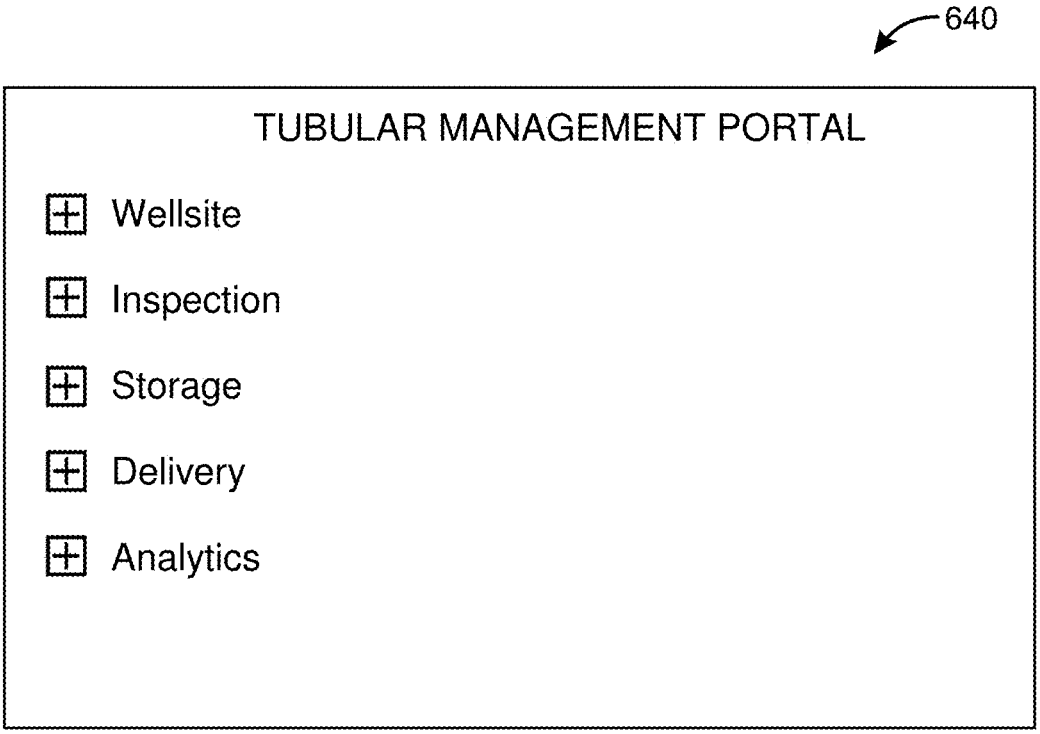
Figures 2, 6:
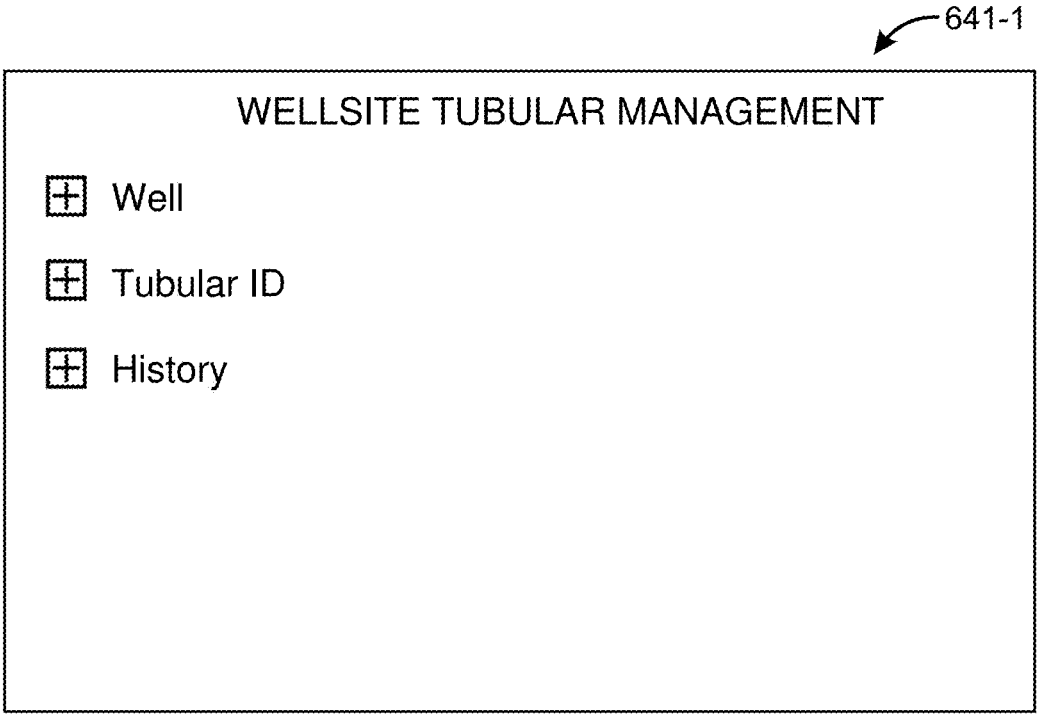
Figures 5, 6:
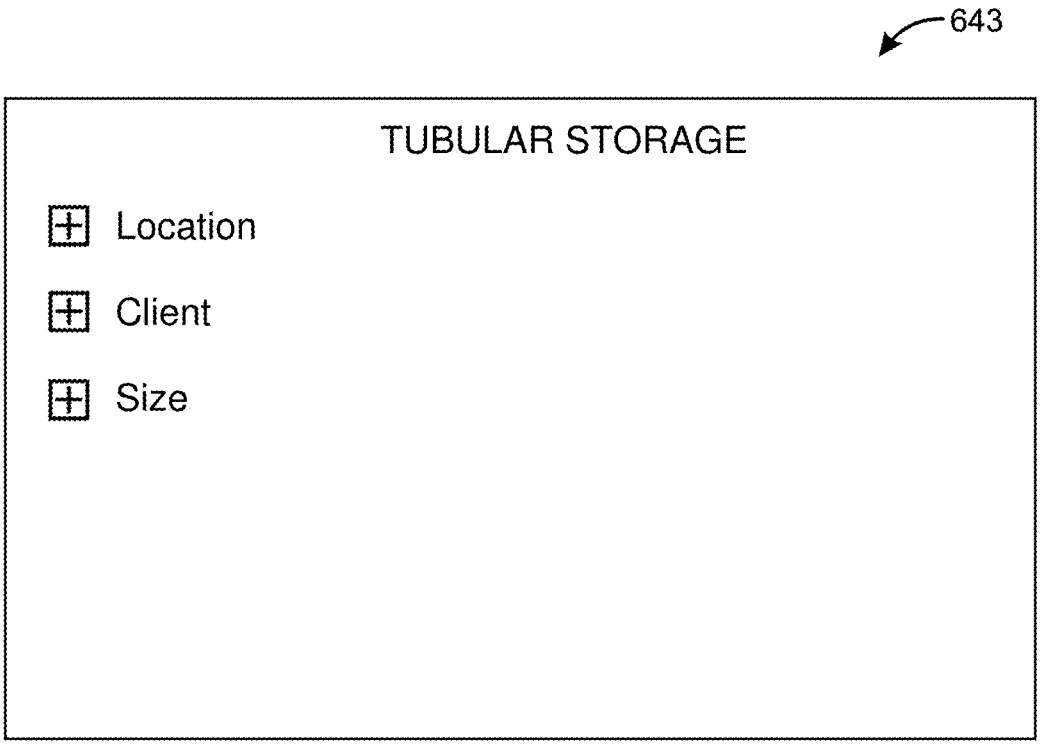
Figure 6:
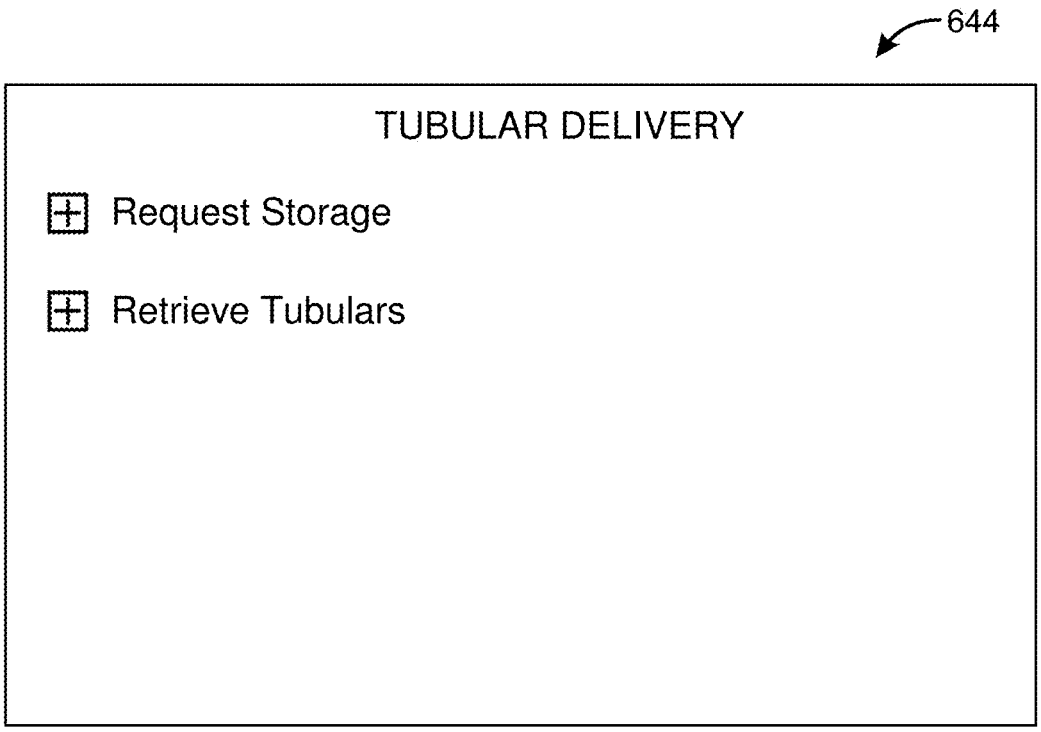

FIG. 6-1 illustrates an example user interface 640 that may be displayed or otherwise rendered on a computing device. The user interface 640 of the present disclosure may be used by an owner of one or more downhole tool assets to manage their assets and/or obtain information about assets. The user interface 640 may also be used by other entities, such as a third party provider of storage, maintenance, remedial, disposal, or inspection services. In some embodiments, the user interface 640 may have different data fields or information available based on access permissions or roles of users, whether the access is by an owner or third party of the tubular asset, or the like. In some embodiments, the user interface 640, a corresponding tubular management system, or both, may be maintained by a third party (e.g., operator of storage or inspection services). In such an embodiment, the view available to the owner of the assets may be considered a "client view."

As illustrated in FIG. 6-1, a user may access or input any number of different types of information about downhole tools. For instance, the user may use the user interface 640 to access a wellsite interface or view, an inspection interface or view, a storage interface or view, a delivery interface or view, an analytics interface or view, or the like. Other or additional interfaces or views may be added or incorporated. For instance, disposal or maintenance interfaces or views may be provided, or potentially incorporated within existing interfaces or views (e.g., the inspection view). Thus, the particular views shown in the interface of FIG. 6-1 are merely illustrative, and do not limit the scope of the views or interfaces that may be used in connection with embodiments of the present disclosure.

With reference to an example wellsite interface, a user interface 641-1 is shown in FIG. 6-2, and includes information specific to a wellsite and/or downhole tools located at the wellsite. For instance, the user may access information about a well (e.g., by searching for a well, by selecting a well from a drop down menu, or the like). In an administrative or input mode, the user interface 641-1 may be used to input information about a well. Example information may include the location (e.g., GPS coordinates or address) of a well, the name of a well, the field in which a well is located, and the like. Other information, including the type of well (e.g., oil, gas, water, etc.), depth of the well, age of the well, well history, well plan, well trajectory, size of the well, whether the well is cased or uncased, or other information may also be input or accessed.

In some embodiments, the user interface 641-1 of a wellsite interface may include information about one or more downhole tools. For instance, the serial number or other identification of particular downhole tools (or categories of downhole tools) may be searched or selected, and information about selected downhole tools may be input or viewed. In some embodiments, by selecting a downhole tool or category of downhole tools, other information may automatically populate in the user interface 641-1. For instance, as shown in FIG. 6-3, in an example of when a particular tubular is identified, the location of the wellsite where the tubular is located, the history of the tubular, and physical or other information about the tubular may each be displayed. In other embodiments, however, information may be displayed in other manners. For instance, by selecting a particular wellsite, a list of each of the downhole tools located at that wellsite (e.g., in use at that wellsite, stored at the wellsite, in transit to or from the wellsite, etc.) may be displayed. The user may then select a particular downhole tool to get additional information.

In some embodiments, links or associations between different interfaces may be provided. FIG. 6-3, for instance, shows a user interface 641-2 giving a history of a particular downhole tool, and includes information about when the downhole tool was made-up, when the tool was inspected, and the like. A link may be provided to allow the user to access other information about the tool, relevant to the tool history. A "make-up" link, for instance, may populate additional information about when the downhole tool was made-up and coupled to other components of a drill string. Such information may include, for instance, the torque applied to make-up the downhole tool, any compounds added to threads to make-up the torque, the type of equipment used to make-up the connection (e.g., power tongs, iron roughneck, etc.), the clamping force applied when making-up the connection, the identification of other components to which the component was attached, and the like. The "inspection complete" link may provide a link to a different interface. For instance, when the tool is shipped offsite for inspection or maintenance, an inspection report may be compiled. That result may be accessed directly from the user interface 641-1 of FIG. 6-2 or the user interface 641-2 of FIG. 6-3.

An example of an inspection report is shown in the user interface 642 of FIG. 6-4. This report may be used to input data upon performing an inspection, or to view information previously input as part of an inspection report. As shown, any number of different types of information may be included. In this particular embodiment, the relevant downhole tool may include a drill pipe. The inspection may identify the inner and outer diameters of the pipe section and the tool joints (or corresponding wall thicknesses), whether any internal or external cracks or pitting were observed, an ultrasonic, x-ray, acoustic, or other inspection analysis, observations on hardbanding conditions, observations on thread conditions, the length of the downhole tool, pictures of the downhole tool, and the like. The information may be stored and accessible at any time through the user interface 642. As the tubular or other downhole tool is inspected multiple times, the results of each inspection may be stored and potentially linked to show the progression of the condition of the downhole tool over time.

In some embodiments, any maintenance performed or recommended may also be included in the user interface 642, although a separate interface may also be provided in accordance with some embodiments. Such an interface may include a listing of what actions were taken, when they were taken, and where they were taken. For instance, information about applied hardbanding, re-cut tool joints, re-faced tool joints, weld repairs, and the like may be included in the user interface 642 or in one or more separate interfaces.

Still other user interfaces for managing downhole tool assets are shown in FIGS. 6-5 to 6-8. FIG. 6-5, for instance, illustrates a user interface 643 for managing storage of downhole tools. In some embodiments, the user interface 643 may be used by a third party (e.g., party who stores, inspects, certifies, remediates, etc. the downhole tools) rather than the owner of downhole tool assets, although in other embodiments the user interface 643 may be modified for use by an owner of the assets. In some embodiments, data may be input or accessed through the user interface 643 to determine, for example: what different locations are being used to store downhole tool assets; what clients/customers/owners are storing downhole tools; and what sizes or types of downhole tools are being stored. In some embodiments, different features on the user interface 643 may act as filters. For instance, a user can specify a particular location, and the customers and types of assets at that location may be limited based on the filtered location. By filtering the location and customer, an even narrower listing of available types of downhole tools may be listed. In some embodiments, the filters may be applied to identify specific downhole tool assets. Specific data about the downhole tool assets (e.g., size, usage history, inspection history, maintenance history, etc.) may then be accessed or input. Filters may thus be used to limit or even auto-populate information in the user interface 643. The other user interfaces of FIGS. 6-1 to 6-8 may use similar filters.

In FIG. 6-6, another particular example of a user interface 644 is shown. In this particular embodiment, the user interface 644 may be a delivery or transport interface. Using such an interface, an owner of a downhole tool may send a request to have the downhole tool shipped to, received by, or stored by a particular entity or at a particular location. Optionally, the request may include a request for maintenance, inspection, certification, or the like. Conversely, if a downhole tool is already being stored, the owner may retrieve the downhole tool by, for example, requesting that the downhole tool be shipped to a particular location or made available for shipping or retrieval by the owner or still another third party. The shipping location may be another storage location, an inspection facility, a maintenance facility, a certification facility, a wellsite, a scrap yard, or any other desired location.

Figures 6, 7:
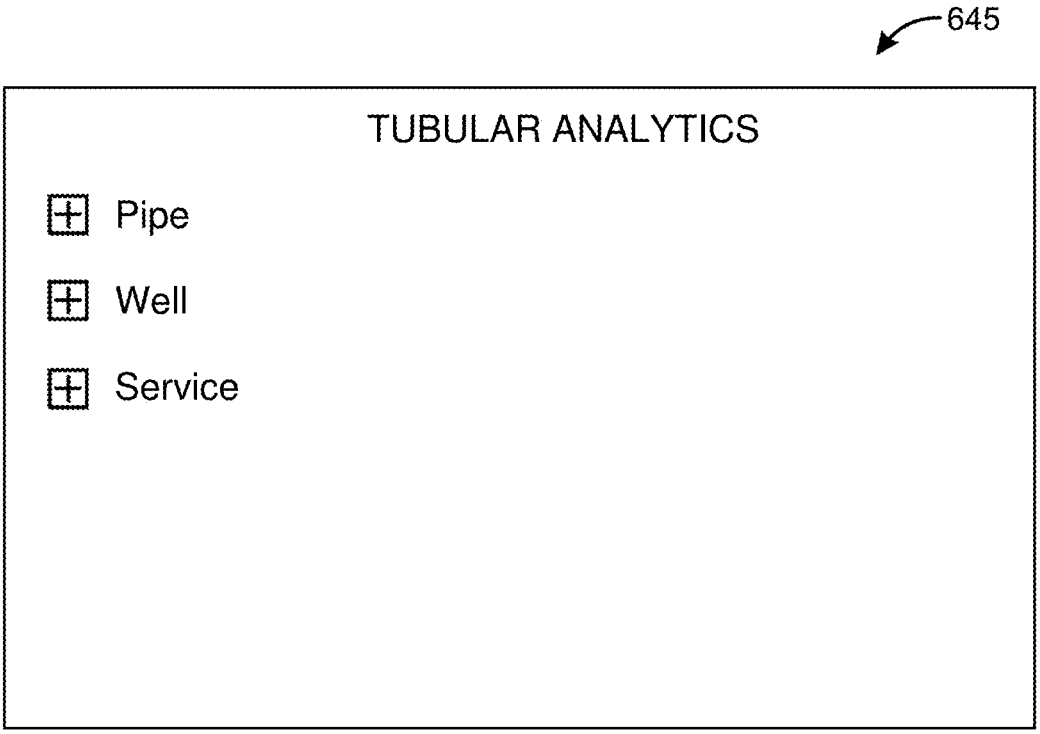

According to at least some embodiments, an analytical module may be accessed to perform analysis on downhole tools, planned jobs, tool inventories, or the like. FIG. 6-7, for instance, illustrates an example user interface 645 that may be used to analyze downhole tool assets or access or filter assets based on analysis that is performed. Example analysis may include, for instance, the type (e.g., identification, class/category, size, etc.) of asset, the well where located or used, the service performed, or the like. Other potential categories of analysis may also be used, including those described herein, or which would be apparent to one having ordinary skill in the art in view of the disclosure herein. For instance, analysis of downhole assets may be performed based on the temperature or pressure of a wellbore, the formation type, whether the wellbore is cased/uncased, the type of mud or drilling fluid used with the downhole tool, the number of pumping hours for the pipe, the depth of the pipe, the location of the pipe on a BAH or drill string, the rotating hours, the time in hole, etc.

In at least some embodiments, the analysis model may track histories of different downhole tool assets based on different conditions, uses, and the like. For instance, multiple drill pipes may be inspected before and after a particular job at a well. Based on the type of job, the well, the drilling fluid, the time downhole, the rotating time, the formation type, and the like, a model may be developed to correlate the wear or other damage to the drill pipe to the particular location or job performed. For instance, a simple model may include an average wear rate for different components based on any of the described conditions, although more complex models may also be developed. As increased amounts of data are obtained from other drill string components, the model may be refined. Thus, a downhole tool management system may be used to track service, maintenance, inspection, storage, and other data, and may further be used to develop an analytical model. The analytical model may use historical data to, for example, predict when a particular downhole tool asset should receive maintenance or be inspected (e.g., based upon what job was performed, the well performed, the time downhole etc.). Similarly, the analytical model may be used to determine which assets should be used for a particular job. By way of illustration, if it is expected that a particular job will be performed at a specific well, with a specific type of drilling fluid, for an anticipated time downhole, the analytical model may be used to determine which downhole components can handle the wear that is expected without failure or damage. The analytical model may further be able to aggregate data over multiple locations (e.g., multiple storage locations). This can allow the analytical model to determine where to pull downhole tools from in order to perform a particular job.

In one illustrative example, the historical data about a downhole asset may be used to determine the average wear per hour of rotational time, which optionally may be further refined based on drilling fluid type, location, position in the drill string, and the like. Based on an anticipated job, the average wear per hour may be used to predict whether the asset will wear beyond allowable thresholds. For instance, the wear may be predicted using the following formula:

$$E_d = P_d \alpha A_w t$$

In the above equation, $E_d$ is the estimated diameter after the job, $P_d$ is the diameter when entering the well and $A_w$ is the average diametrical wear per hour (e.g., per total in the hole or per hour rotating in the hole) based on historical information, t is the time in the well (e.g., total time or rotational time), and $\alpha$ is a dimensionless inspection coefficient. In some embodiments, the inspection coefficient may be used as a safety factor to reduce the likelihood that above average wear will result in failure of the tool. For instance, the inspection coefficient may be 1.05, 1.1, 1.2, or 1.25, although in other embodiments, the coefficient may be less than 1.05 or greater than 1.25. In still other embodiments, the coefficient may be a different value or may be omitted. In some embodiments, the $A_w$ value is different for different types of tools, sizes of tools or components, materials, wellsites, types of operations, formations, positions in a wellbore, drilling fluid types, and the like.

The equation above is also merely illustrative of one example wear model for a downhole tool, and other models may be used. Further, while the above model may be used for inner and outer tool diameters, inner and outer tool joint diameters, and the like, in some embodiments different models may be used for inner diameters than for outer diameters, or for tool diameters than for tool joint diameters. Further, different models may be used for tools or components of different sizes, materials, and the like, or the $A_w$ or $\alpha$ values may be different for different sizes, materials, and the like.

Whatever model is used, the results of the modeling may be compared to a minimum allowable diameter to determine whether the pipe may be used for an anticipated job. In other embodiments, the model may be used after a job to predict whether the pipe should be inspected. In such an embodiment, any pipe with a diameter below a threshold inspection diameter could be set aside for expanded inspection. It should also be appreciated in view of the disclosure herein, that while the above model is used to determine diameters, the models could be adapted to determine wall thickness by for example, calculating half of the difference between the estimated inner and outer diameters.

In some embodiments, the wear rate may be related to the deterioration of a thread or tool joint. An example predictive wear model used to determine a condition of a thread or tool joint, may include the following:

$$E_{tc}=P_{tc}\alpha\Sigma(\beta A_{td}T_{mu})$$

In the above equation, $E_{tc}$ may be a dimensionless value representing predicted thread condition, $P_{tc}$ may be a dimensionless value representing thread condition when the tool enters the well, and $\alpha$ may be a dimensionless inspection coefficient similar to, or different than, the inspection coefficient discussed above. Additionally, $A_{td}$ may be the average thread or tool joint deterioration based on historical information, and may be scaled to be dimensionless. $T_{mu}$ may be the make-up torque applied to the tool joint or threads (e.g., in kPa) when making-up a connection, and $\beta$ may represent a conversion coefficient representing the impact torque values have on thread or joint deterioration, and may have dimensions of 1/kPa. As discussed above for the $A_w$ and $\alpha$ values, the $A_{td}$, $\alpha$, and $\beta$ values may be selected based on particular properties, such as the type and size of the threaded connection, the materials used, the threadform, the type of tools making up the connection, the thread compounds used, and the like.

In the above formula, the ($\beta$ $A_{td}$ $T_{mu}$) portion may represent the effect of each make-up and break-down of a connection, which is then aggregated, multiplied by the inspection coefficient, and subtracted from the initial condition. Based on this value, it can be predicted how many times a connection can be made before it deteriorates below a threshold level, or whether a connection should be further inspected or repaired. As will be appreciated in view of the disclosure herein, any number of models may be used to predict wear or condition of a threaded connection.

Figures 6, 7, 8:
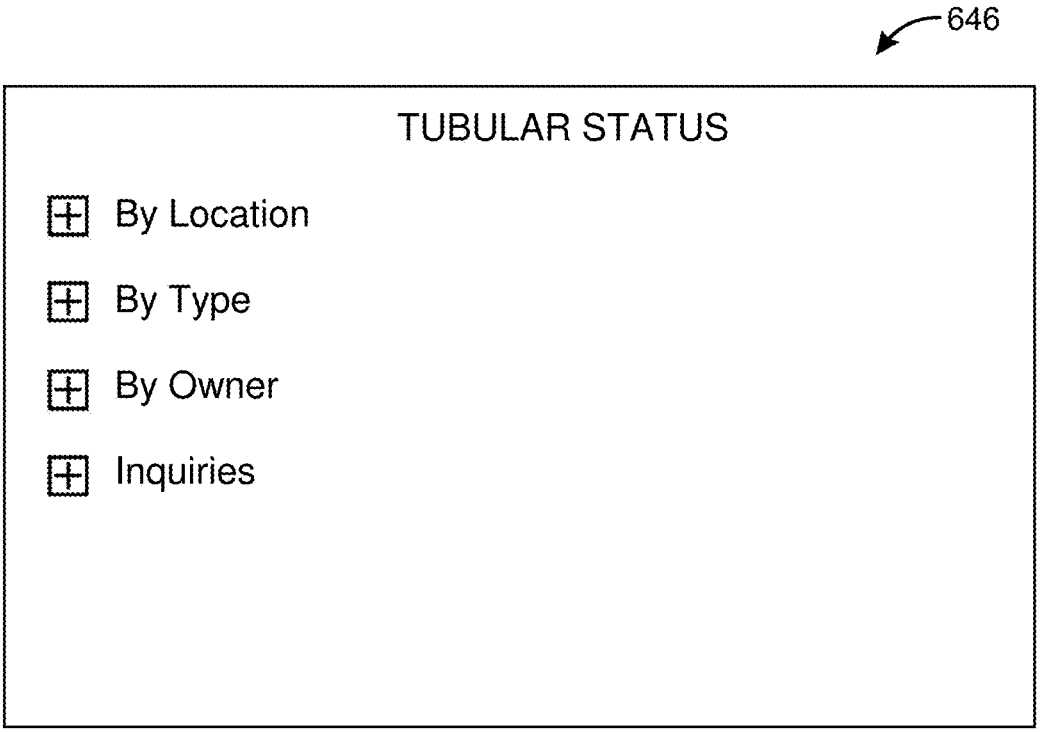
Figures 1, 7:
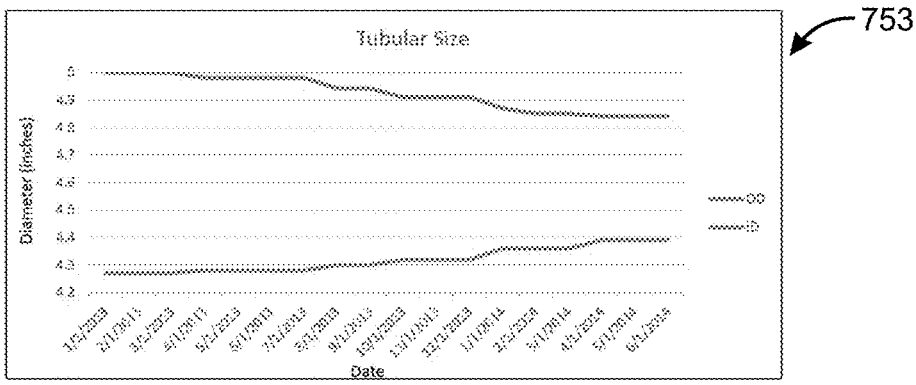
Figures 2, 7:
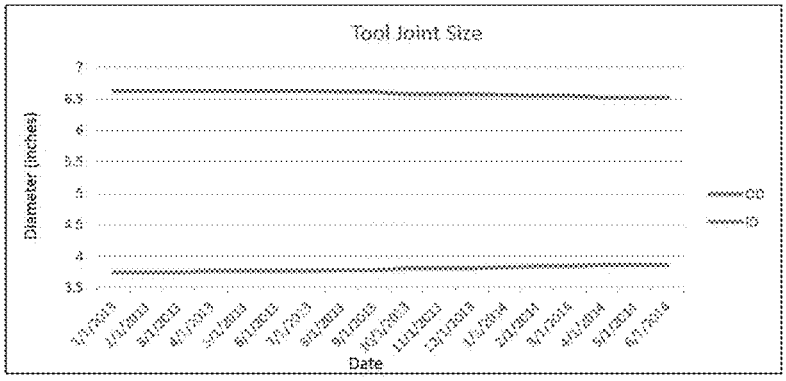
Figures 3, 7:
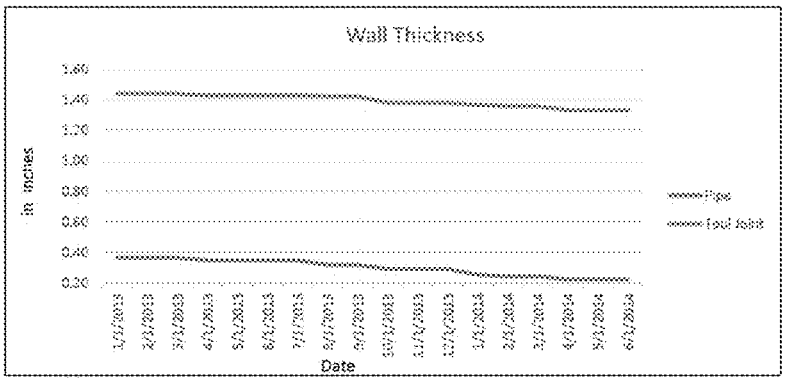
Figures 4, 7:
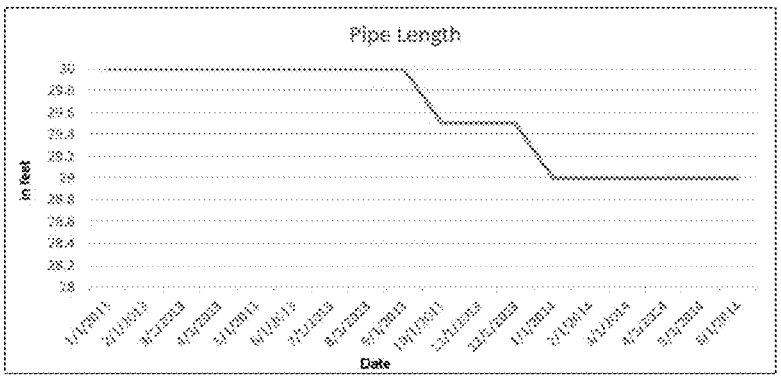

FIG. 6-8 illustrates another example user interface 646 that may be used in some embodiments of a tubular management system. As discussed herein, downhole tools may be tracked at a wellsite, while offsite, or at any other location. For instance, downhole tools can be tracked at third party storage or service locations. In part, the user interface 646 may be used to input or access information on what downhole tool assets come in to a particular location, what assets are sent out of a location (and where to), what the location or status of an asset is at any instant of time, what the results of inspection/maintenance/service are, and the like. In some embodiments, the some or each type of information may be captured automatically (e.g., using RFID tag or other automated tracking systems), and in other cases some or each type of information may be captured manually. For instance, as an inspection is completed, a machinist, inspector, welder, quality control operator, inventory manager, or other person may fill in an electronic questionnaire or other form that is part of the asset management system. The form can be electronically submitted and captured so that the real-time status and location of a downhole tool asset can be known at any particular time. Thus, combinations of automatic and manual tracking and data capture may also be used.

With the information captured, the user interface 646 may be used to review groups of assets or even specific assets. For instance, each asset at a particular location, of a particular type, or of a particular customer can be identified and filtered. Inquiries may also be sent to, for example, ask about shipping an asset to or out of a particular location, requesting an analysis of which assets would be suited for a particular future job, and the like.

In the various interfaces described and contemplated herein, access to full histories of particular downhole tool assets and types of assets may be provided in any suitable form. For instance, data may be available graphically, textually, or in other formats. FIGS. 7-1 to 7-4 illustrate further examples of reports or data for a particular downhole tool asset over time, based on completed inspection data. In particular, FIG. 7-1 includes a report or graph 753 illustrating changes to the outer diameter (top line) and inner diameter (bottom line) of a pipe section of a drill pipe over an 18-month period. As shown, the outer diameter gradually decreases while the inner diameter gradually increases. FIG. 7-2 illustrates a graph 754 of changes to the outer diameter (top line) and inner diameter (bottom line) of a tool joint over an 18-month period, and also shows the outer diameter gradually decreasing while the inner diameter gradually increases. The particular effects of the changes in FIGS. 7-1 and 7-2 can also be seen in FIG. 7-3, which shows a graph 755 showing the extent of changes to tool joint and pipe section wall thicknesses over time (with both decreasing).

FIG. 7-4 shows a graph 756 of the length of the drill pipe over time. As shown, the drill pipe changes length at two points in time. In some embodiments, the changes in length may correspond to service or maintenance of a drill pipe, such as when a tool joint is re-cut. As should be appreciated in view of the disclosure herein, each type of data disclosed herein can be correlated to specific events, jobs, locations, etc. For instance, where a downhole tool is inspected before and after a particular type of job, at a particular well, for a particular period of time downhole, at a particular depth, for specific rotating and/or pumping times, with a known drilling fluid, etc., changes to wall thickness or diameter, the presence of pitting or cracks, and the like may be correlated to that job. Over time, historical data may be accumulated to develop an analytical model (e.g., a wear model) that correlates wear/damage to the location, operating conditions, or other aspects of a job.

While FIGS. 7-1 to 7-4 graphically illustrate parameters of a downhole asset over time, similar information may be obtained in a log. For instance, a log may textually provide information about the downhole asset, such as the date of inspection and the results of such inspection. In some embodiments, such as where parameters associated with a downhole asset are being controlled, a log may provide information on what parameters were controlled, the parameter values, and the like. Table 1, for instance, shows an example log that may be used for a downhole asset in which make-up and break-down is controlled.

TABLE 1

| | Asset No. T892246E51 (3-½" NC38 Drill Pipe) | | | | | |
|---|---|---|---|---|---|---|
| | | Mating | Max Torque (N-m) | | Time to Max Torque | |
| Date-Time | Operation | Asset | Target | Actual | Target | Actual |
| 07/18-17:36 | Pin Make-Up | F381232P17 | 25,000 | 25,509 | 0:30 | 0:32 |
| 07/18-17:39 | Box Make-Up | F842218A34 | 25,000 | 25,832 | 0:30 | 0:32 |
| 07/19-00:11 | Box Break-Down | F842218A34 | 20,000 | 18,499 | 0:30 | 0:25 |
| 07/19-00:12 | Pin Break-Down | F381232P17 | 20,000 | 20,100 | 0:30 | 0:24 |
| 07/19-04:27 | Pin Make-Up | M003484I37 | 25,000 | 26,333 | 0:30 | 0:37 |
| 07/19-04:54 | Box Make-Up | I234881B00 | 25,000 | 23,742 | 0:30 | 0:45 |
| 07/19-19:18 | Box Break-Down | I234881B00 | 20,000 | 19,555 | 0:30 | 0:43 |
| 07/19-19:21 | Pin Break-Down | M003484I37 | 20,000 | 19,660 | 0:30 | 0:35 |
| 08/02-08:44 | Pin Make-Up | O586127R95 | 25,000 | 24,915 | 0:30 | 0:41 |
| 08/02-08:51 | Box Make-Up | L684738T27 | 25,000 | 23,887 | 0:30 | 0:42 |
| 08/02-14:02 | Box Break-Down | L684738T27 | 20,000 | 18,788 | 0:30 | 0:36 |
| 08/02-14:04 | Pin Break-Down | O586127R95 | 20,000 | 19,058 | 0:30 | 0:26 |
| 08/06-20:21 | Pin Make-Up | N378776E05 | 25,000 | 25,163 | 0:30 | 0:23 |
| 08/06-20:26 | Box Make-Up | U759471Y30 | 25,000 | 25,258 | 0:30 | 0:25 |
| 08/09-07:33 | Box Break-Down | U759471Y30 | 20,000 | 20,323 | 0:30 | 0:36 |
| 08/09-07:38 | Pin Break-Down | N378776E05 | 20,000 | 21,628 | 0:30 | 0:44 |
| . | . | . | . | . | . | . |
| . | . | . | . | . | . | . |
| . | . | . | . | . | . | . |

As will be appreciated by one skilled in the art, in view of the disclosure herein, data in a log format may also be converted to graphical or other displays or views, may be used in connection with other aspects of the present disclosure (e.g., predicting wear or when inspection should be performed), or may be otherwise used or displayed. Further, the data in Table 1 is illustrative only, and additional or other information may be included, including any of the information described herein. In some embodiments, for instance, additional or other columns of data in Table 1 may include the actual or target clamping force during an operation.

Figure 9:
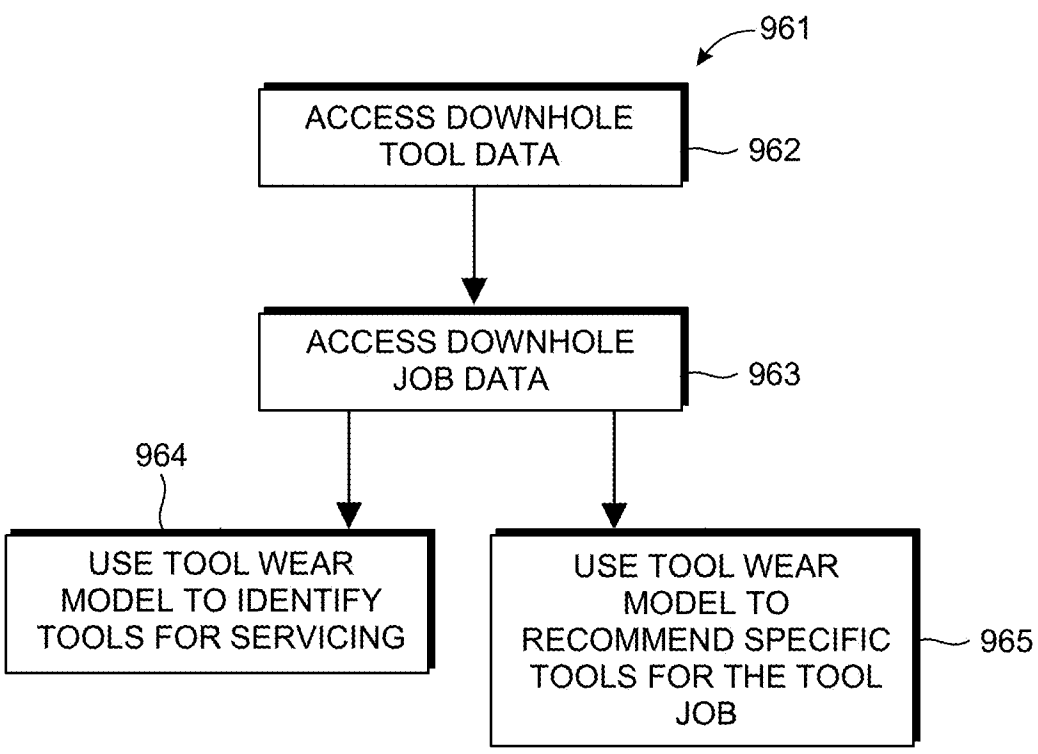
FIG. 9 is a flow chart of a method of using a tubular wear model to predict when downhole tool assets should be serviced or which assets should be used for an anticipated job, according to some embodiments of the present disclosure.
Figure 8:
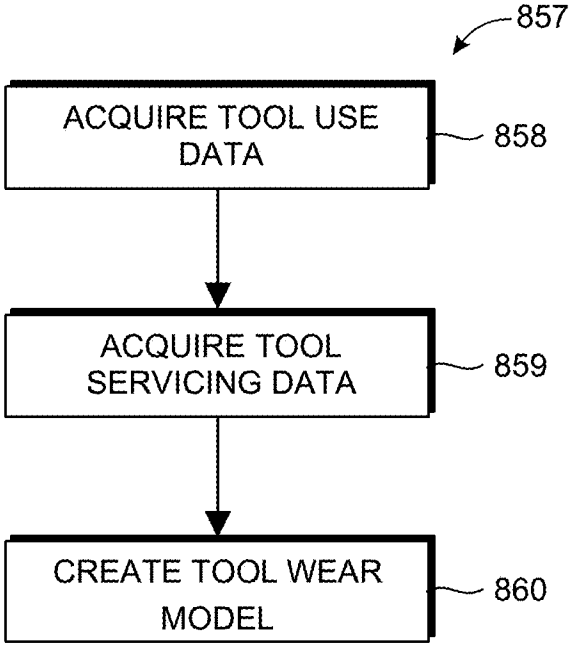

FIGS. 8 and 9 are flow charts of different manners in which a wear model may be developed and or used in accordance with some embodiments of the present disclosure. For instance, FIG. 8 illustrates a flow chart of a method 857 for developing a tool wear model. In particular, the method 857 may include acquiring tool use data at 858. Such data may be acquired manually, automatically, or using automatic and manual data acquisition. The tool use data may include any number of types of information, such as the well where the tool was used, the time in the well, the rotating hours, the weight-on-bit, the position in the drill string, the pumping hours, the temperature, the pressure, the formation type, the casing size/type, the mud type, tool vibration data, the type of service/job performed, the make-up torque, the break-down torque, the make-up clamping force, the break-down clamping force, etc. When the tool is retrieved from the well, tool servicing data can be acquired at 859. In at least some embodiments, the tool servicing data can include inspection data. Servicing or inspection data may include information on changes to tool dimensions and wall thickness, presence of cracks or pitting, damage to hardfacing or other gauge protection elements, damage to cutting elements, thread or tool joint condition, and the like. Acquiring tool servicing data at 859 may also include, in some embodiments, accessing previous tool servicing data to compare current data to prior data. The servicing data and use data may then be used to create a tool wear model at 860. For instance, changes to the dimensions or condition of the tool as obtained at 859 may be correlated with tubular use data acquired at 858. In some embodiments, acquisition of data at 858 and 859 may be performed multiple times for the same or different tools. Creating the tool wear model at 860 may therefore include determining average or other statistical correlations between use data obtained at 858 and servicing data obtained at 859. In other words, the tool wear model may be based on historical data and may show the correlation between particular types of use and the amount of wear, damage, or other changes to conditions of a downhole tool.

Once the wear model is created (and it may continually be refined), the wear model may be used in any number of ways. FIG. 9, for instance, illustrates a method 961 for identifying tools for servicing or for a particular downhole job. In particular, the method 961 may include accessing tool data at 962 for one or more downhole tools. This may be accessed by using, for instance, an asset management system to access the tool type, tool size, tool status, tool location, and the like. This information may have been obtained and recorded in the asset management system through automated or manual entry of data, and may include information as described herein. The method 961 may also include accessing downhole job data at 963. The downhole job data may include information such as a job location, conditions of a job (e.g., time downhole, rotating time, pressure, temperature, drilling fluids, make-up torque, make-up connections, depth, well trajectory, etc.). Using such tool and job information, a tool wear model may be applied at 964, at 965, or at both 964 and 965. In applying the tool wear model at 964, the method 961 may include identifying tools for servicing (e.g., inspection, certification, repair, etc.). This may be performed where, for example, the tool data includes information about a tool prior to performing the job, and the job data includes data of a job being performed or that has been completed. The tool wear model may then be used to identify wear or damage to tools that may be outside a desired threshold in order to select those that should be serviced. Specifically, using the wear model at 964 may include using the previous condition of the downhole tool obtained at 962 and applying the wear model to determine the expected condition of the tool after use in the job identified at 963. If one or more conditions are below or above a corresponding threshold level, the tool may be identified as one for which inspection or maintenance should be performed. For instance, if the wall thickness, thread or tool joint condition, cutter condition, hardfacing condition, crack condition, pitting condition, or the like are expected to fall below or exceed a relevant threshold, inspection may be suggested, and potentially automatically scheduled. Accordingly, the tool wear model is used at 964 to predict whether tools should go in for inspection, what type of servicing may be needed, or other actions that should be performed.

Identifying the tools to be serviced can include recommending tools for servicing. Such information may be output visually or electronically output. For instance, a display on a computing device can be generated to display the recommendation. In some embodiments, a request for servicing can be automatically be generated and submitted through the asset management system to a third party or other servicing organization so that shipment, receipt, inspection, certification, or other actions can take place.

In some embodiments, the method 961 may include using the wear model to recommend specific tools for a job at 965. In such an embodiment, the tool data accessed at 962 may be current tool data (e.g., after the most recent inspection or other determination of tool properties, condition, etc.). The job data accessed at 963 may be anticipated job data, which can include various types of information as discussed herein. Example job data may include the location of the job (e.g., well location, well name, etc.), the type of job (e.g., drilling, milling, fishing, etc.), or the job conditions (e.g., time in hole, rotating hours, pumping hours, weight-on-bit, temperature, pressure, formation type, drilling fluid type, make-up torque, break-down torque, clamping force, etc.). The tool wear model may then be used at 965 to recommend or otherwise identify specific tools to be used for the anticipated job. For instance, by reviewing an inventory of available tools, the current conditions of those tools may be determined, and the wear model can be used to determine the amount of wear/damage to be expected in performing the job. The model may thus determine which tools can withstand the expected wear/damage, and which tools should be used (even if in different locations) based on shipment costs, time of delivery, and the like. Tools that withstand the expected damage may include those expected not to fail as a result of the wear/damage or those not expected to be recommended for servicing after the job. In still other embodiments, tools that are recommended for the job may include those that are to be serviced/inspected after the job, but expected to be less critically damaged. Tools may also be identified from numerous locations, and in some embodiments, the tool wear model may provide priority for tools at specific locations that have, for instance, faster delivery times, lower cost shipping, etc. In some embodiments, the tool wear model may also produce a report of recommended drill string or BAH make-up. For instance, different drill pipes may be recommended for different locations on the BAH, different depths in the wellbore, and the like. Use of the tool wear model at 965 may therefore include comparing different assets, organizing assets for shipment, organizing assets for delivery, determining a drill string construction, or other features. In some embodiments, the recommendation may include automatically generating shipping information for assets located at one or at multiple locations. The recommendation may also include automatically generating a recommendation for how to arrange assets within a drill string.

It should be appreciated in view of the disclosure herein, that a tool management system of the present disclosure may include a variety of features to facilitate tracking of downhole tool assets, managing parameters associated with downhole tool assets, the acquiring or delivering of downhole tool assets, and the use of downhole tool assets. A client portal, for instance, may allow an owner of assets, or another client, to login and see the real-time status, location, and history of any downhole tool tracked by the system. The client could be allowed to run their own comparative or predictive analysis using analytical tools that are provided, or adjust the target parameters for any particular downhole tool. Example analytical tools may include historical models, tool wear models, and the like based on the client's own assets, or based on the assets of multiple clients. Such analysis may potentially be run even without engaging the operator of the tubular management system. Through the client portal, the client may also be able to request shipments of assets, request storage of assets, request inspection, certification or maintenance services, or otherwise submit inquiries or requests.

Data acquisition and parameter control for downhole tool assets may also be manual or automated. Where data acquisition is automated, such automation may occur using any number of techniques, and at any number of locations. For instance, a downhole tool may have a serial number stamped or printed thereon. Inspection, shipment, delivery, etc. of an asset may be requested or confirmed by correlating the serial number with the corresponding action. In some embodiments, the serial number may be read manually. In other embodiments, a scanner may read the serial number. The serial number may be in the form of a bar code or other graphical indicator to facilitate scanning, although text recognition scanning may be employed to recognize standard alphanumeric characters in some embodiments. In another embodiment, an RFID tag or other encoded marker may be included on or in the downhole tool. For instance, an active or passive RFID tag may be coupled to drill pipe or other downhole tool assets, and can contain the serial number or other identification of the asset.

RFID trackers may be placed throughout an inspection, maintenance, or storage facility, on a drill rig, or at any number of other locations. For instance, as a shipment is received in a storage facility (or an inspection, maintenance, or other servicing facility), an RFID tag reader may be located at the receiving location. Placing the received shipment in receiving may thus allow the reader to identify each downhole tool asset that is received. The RFID tag reader may communicate with, or be part of, a tool management system, and can update a tool's record with the real-time location of the tool. As the tool moves throughout the location (e.g., from receiving to inspection, from inspection to maintenance, from maintenance to storage, etc.), the downhole tools may come into proximity with different RFID tag readers, and the location may be updated. In some embodiments, the forklifts, trucks, etc. of the equipment used to move the downhole tool assets may themselves have RFID tag readers to keep track of when the assets were moved, where they were moved to, which equipment moved the assets, and the like. Inspection or maintenance equipment may also have RFID tag readers, and upon performing inspection or maintenance services, the results of the services may be automatically saved to the asset record in the tool management system. For instance, an automated hardfacing machine may include an RFID tag reader. Upon completion of the hardfacing job, the automated system may update the tool management system with the type of hardfacing applied, when it was applied, the dimensions of the hardfacing, etc. Ultrasound, acoustic, or other inspection equipment may similarly automatically update an asset record with inspection results. In at least some embodiments, an RFID tag reader may also write information to an RFID tag (e.g., an active RFID tag). That information may then be read by another RFID tag reader and updated and/or saved to a data store of a tool management system. Example data that may be written includes inspection data (date, time, inspector, results, etc.), usage history (date, location, torque applied, adjacent assets, etc.), and the like. Further, any number of tags may be used. For instance, each tool joint may include a tag, or a single tag may be used for the entire asset. In other embodiments, more than two tags may be used (one in each tool joint and one in for a center upset or along a body of the asset). Further, in addition to RFID technology, Bluetooth, RuBee, Memory Spot, or other technologies may be used.

One or more RFID tag readers may also be located at a wellsite to track tool assets and the manner in which they are used. For instance, an RFID tag reader may be located at a pipe handler on a rig, so that the location of specific drill pipes may be known and/or to allow the rig to select a particular drill pipe to be made up in a drill string. A tong, spinner, torque assembly, roughneck, or other make-up device may also include an RFID tag thereon, or may be in communication with an RFID tag (e.g., near the rotary table above the rig floor, on the drawworks, on a tugger, on the rig structure, etc.). An RFID or other tag reader (or multiple readers in the same or multiple locations) may also be located in any number of locations. For instance, the tag reader may be located on, near, or in communication with, automated make-up systems, mud control systems, automated drillers, pasons, well graphing tools, well information transmission systems, wired drill pipe tools, rig instrumentation, catwalks, v-door, stands, elevators, monkeyboards, kellys, top drives, bales, ratholes, pipe decks, pipe racks, storage areas, blow-out preventers, slips, rotary tables, stabbing guides, hydrils, bell nipples, rotating heads, setbacks, and any devices now or in the future that may be within a range of reading or obtaining data on the relevant tools. Such reading devices may be below or above the rotary table. Where possible, the reader devices may be in Zone 1 (i.e., around the wellhead), or Zone 2 (i.e., according to the relevant API specification, which may be further than 2 m from the wellhead based on enclosures). In some embodiments, the reader may be in a doghouse, in casing running equipment, in clothing of personnel (e.g., belt, shoes, glasses, protective helmets, etc.), in a handheld reader, on the wellhead, on casing, or in any other pipe handling, storage, transport, or sequencing location/equipment.

According to at least some embodiments, a make-up device may be at least partially automated, and the assets (e.g., tool joints of downhole tool assets) that are made-up and broken-down may be identified, and the amount of make-up/break-down torque applied, the amount of clamping force applied, and the like may be stored as part of the assets' records in the tool management system, or on the asset itself Additionally, as drill pipe or other tools are tripped in and out of the wellbore, the RFID tag reader can detect tools that enter and exit the wellbore. The make-up device or other system may thus automatically determine the amount of time a component spends downhole. Where coupled to a top drive, rotary table, fluid system, or the like, the system may also determine features such as the rotating time, the pumping time, the fluid type, etc., which may be automatically saved to a downhole tool asset record. Location of the well may also be automatically tracked and saved to asset records by automated components at the wellsite.

Figure 10:
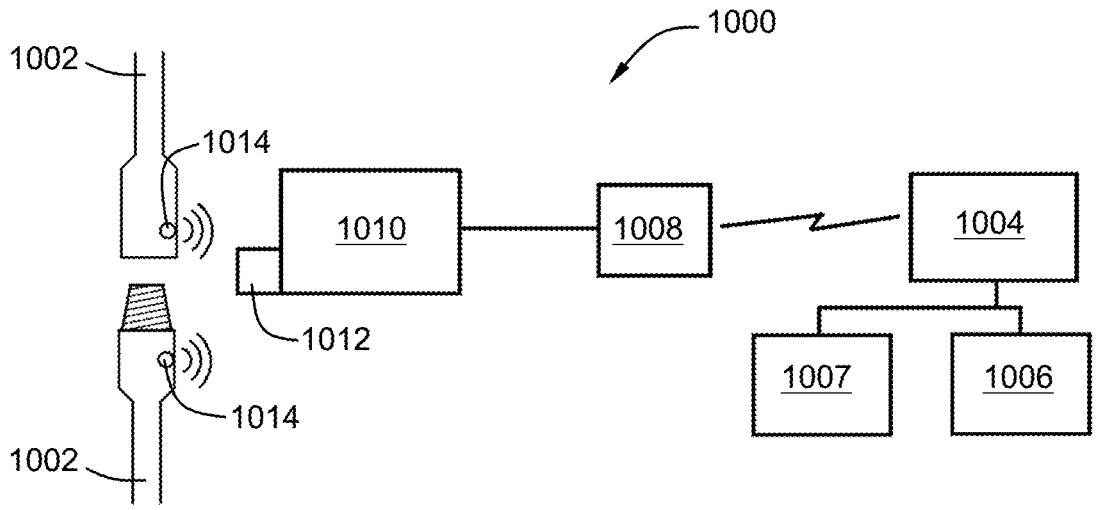
FIG. 10 is a schematic illustration of a system for managing downhole assets, according to some embodiments of the present disclosure.

FIG. 10 is a schematic representation of an example comprehensive system 1000 for managing downhole assets 1002, including drill pipe and other tubular members, in accordance with embodiments of the present disclosure. In particular, the system 1000 may include an asset management system 1004 that stores, processes, or otherwise uses data of various downhole assets. The asset management system 1004 may include or be coupled to a predictive analysis module 1006 and/or to one or more storage or inspection facility systems 1007. In some embodiments, the asset management system 1004 may also be coupled to a rig 1008, which may allow rig data to be used and stored by the asset management system 1004. Optionally, the rig 1008 may include or be coupled to a torque control device 1010. An example torque control device 1010 may include intelligent or automated power tongs, iron roughnecks, or the like which may be used to make-up and/or break down drill pipe, drill collars, casing, or other downhole assets. The torque control device 1010 may include or be coupled to an asset identification module 1012. The asset identification/detection module 1012 may be used to identify specific downhole assets that are rotated/engaged by the torque control device 1010. For instance, the asset identification/detection module 1012 may include acoustic calipers to identify tool shape/size, an RFID reader to identify a particular serial number or other tool identifier, or any number of other components used to identify a particular tool or category of tools. Where the asset identification/detection module 1012 includes an RFID reader or other similar device, the downhole assets 1002 may include one or more RFID tags 1014 or other devices that can provide data to, and potentially receive information from, the asset identification/detection module 1012. For instance, each tool joint of a drill pipe asset may include an RFID tag 1014. As a result, as the torque control device 1010 makes-up or breaks down the connection between the downhole assets 1002, the tags can be encoded with information about the torque, clamping force, or the like. In addition to, or instead of, being encoded on the RFID tags 1014, corresponding information can be provided by the torque control device 1010 to rig 1008 and/or to the asset management system 1004.

Figure 11:
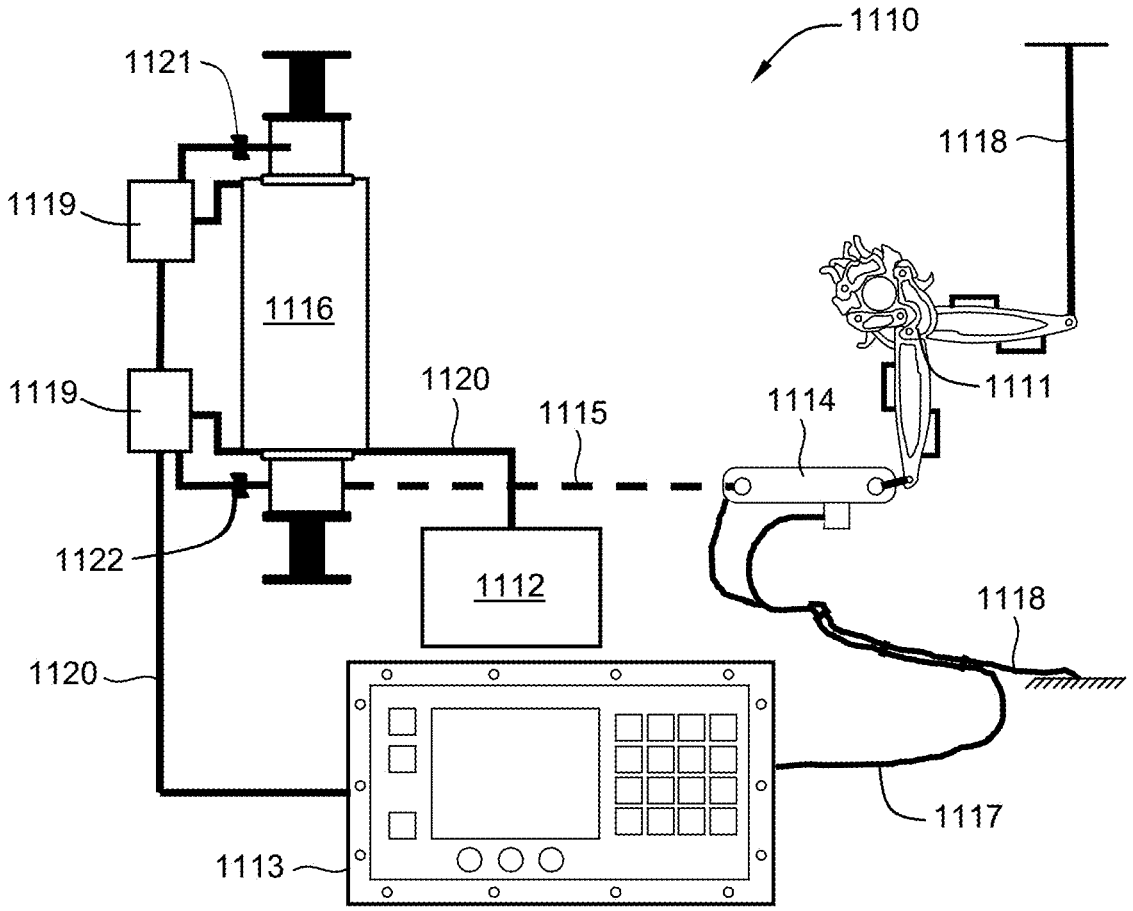
FIG. 11 is a schematic illustration of a system for automating application of torque by power tongs, according to some embodiments of the present disclosure.

FIG. 11 illustrates a schematic view of an example torque control device 1110, according to some embodiments of the present disclosure. In this particular embodiment, the torque control device 1110 may include power tongs 1111. As shown, the power tongs 1111 may interface with a driller's manual controller 1112 or an automated controller 1113, one or more load cells 1114 (and one or more load cell cables/lines 1117), a pull line 1115, drawworks 1116, a snub line 1118, air controllers 1119, air lines 1120, or other features. In some embodiments, a quick release cathead 1121 or quick release make-up cathead 1122 may also be included. In some embodiments, the amount of torque applied by the power tongs 1111 may be controlled or limited by using one or more of the controllers 1112, 1113. The controllers 1112, 1113 may vary the amount of tension in the pull line 1115, and the load cell 1114 may measure the tension to provide feedback to the controller 1113. In some embodiments, the drawworks 1116 may be used to apply and release tension in the pull line 1115.

Figure 12:
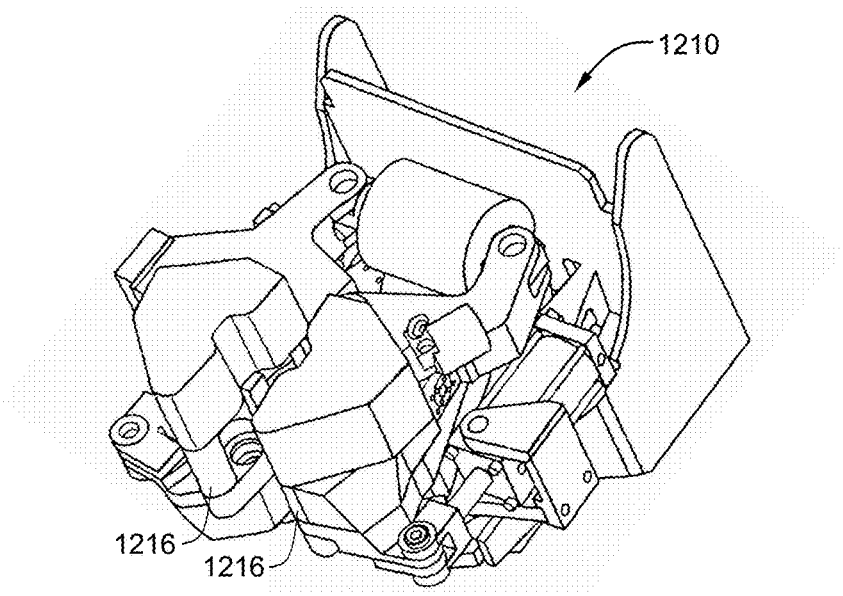
FIG. 12 illustrates a torque application device, according to some embodiments of the present disclosure.

Another example of a torque control device 1210 is shown in FIG. 12, in accordance with some embodiments of the present disclosure. The torque control device 1210 is illustrative of an iron roughneck torque application device, which can be used to apply torque to one or more downhole tools (e.g., downhole tools 1002 of FIG. 10). The torque control device 1210 may include rollers 1216 that grip the downhole tools 1202. At least some of the rollers 1216 may further rotate the downhole tools relative to each other to make-up a threaded connection. The torque control device 1210 may be manually operated (e.g., with an operator using one or more control panels or driller controls), or the torque control may be operated in a more automated or intelligent manner (e.g., torque is controlled/limited in an automated manner according to a predetermined torque profile).

Figure 13:
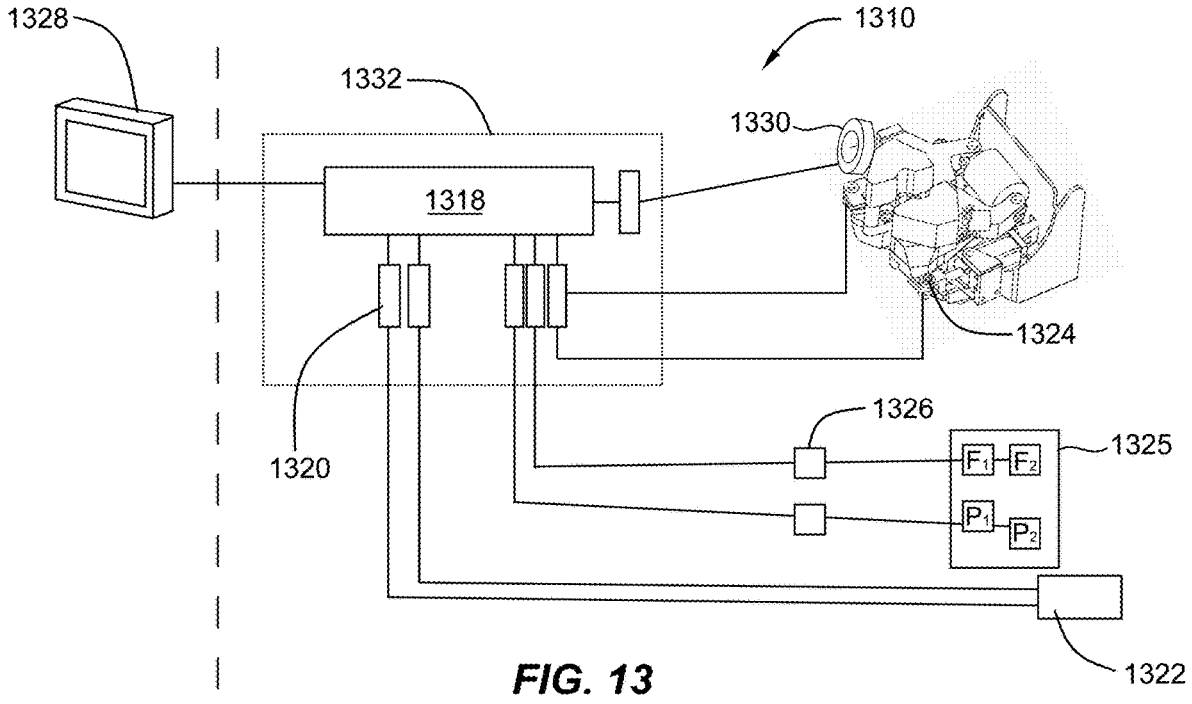
FIG. 13 schematically illustrates a torque control system, according to some embodiments of the present disclosure.

A further example of a torque control system 1310 is more schematically shown in FIG. 13. In the illustrated embodiment, a torque application device such as the device shown in FIG. 12 may be coupled to a controller 1318 or other computing device that may be used to control one or more aspects of the torque control device. In contrast to a power tong control device using a cable pull, the torque control system 1310 may use solenoid controls 1320, control valves 1322, or other features that provide hydraulic control. One or more load pins 1324 may further be used to verify a load on one or more components of the torque control device (e.g., arm for rollers). One or more pressure sensors 1326 may further be used to measure and/or verify hydraulic pressure on the one or more control valves 1322 used to control the hydraulic pressure used to apply torque.

In some embodiments, one or more barriers 1332 may also be provided. The controller 1318, solenoid controls 1320, and barriers may, in some embodiments, be grouped together and included in an enclosure 1332. The enclosure 1332, load pins 1324, control valves 1322, and pressure sensors 1326 may, in some embodiments, be mounted to (or near) the iron roughneck or other torque application device. Such components are shown to the right of the dashed vertical line to illustrate an example embodiment in which the components are located near each other. In contrast, a user interface 1328 may be located outside the immediate vicinity of the torque application device. In some embodiments, the user interface 1328 may be included in the driller's area, doghouse, or other location. Optionally, the left of the dashed vertical line may be considered a zone 2 area, while the right of the dashed vertical line may be a zone 1 area.

According to some embodiments, a manually controlled torque application device may include pressure gauge dials 1330 to allow manual operation based on visual observations. Torque arm length can change based on the outer diameter of the downhole tool being torqued, and may not be taken into consideration in the dial reading. The torque arm is therefore not constant and larger downhole assets can have larger torque multipliers. The force applied may, in some embodiments, equal the pressure multiplied by a piston surface area (which may be accumulated over more than one cylinder). To hydraulically manipulate a torque application device, a hydraulic circuit 1325 may be used. An example hydraulic circuit may include "F" locations used to apply force, and "P" locations at which pressure is applied. Further details of an example hydraulic circuit that may be used are shown in U.S. Patent Application Ser. No. 62/198,273, previously incorporated herein by reference. The actual force at the points "F" may be related to the pressure inside the cylinders on the interior surface of a piston. The actual force may further be affected by seal quality, wall friction, and other factors. In some embodiments, a torque application or control system of the present disclosure may monitor the health of the downhole asset. For instance, the seal quality or seal loss of a tool joint, wall friction, crack formation, pitting, thread damage, and the like can be monitored and even used in calculating or controlling torque. Optionally, when seal loss, wall friction, thread damage, pitting, cracking, or the like exceeds a desired threshold, the downhole asset may be flagged or otherwise identified as being a candidate for inspection or maintenance (e.g., repair).

As noted herein, in a manual operation scenario, a pressure dial 1330 may not take into consideration the true torque arm that is affected by the outside diameter of the downhole asset being torqued and clamped. For instance, the pressure dial 1330 may have the same reading for drill pipes having different diameters, but by virtue of the drill pipes having different diameters, the torque arm is different. In some embodiments, by measuring and/or controlling forces and pressure (e.g., at "F" and "P" locations as discussed herein), and particularly in combination with knowing the size of the asset being torqued, the true torque can be measured and/or controlled in real time.

Figure 14:
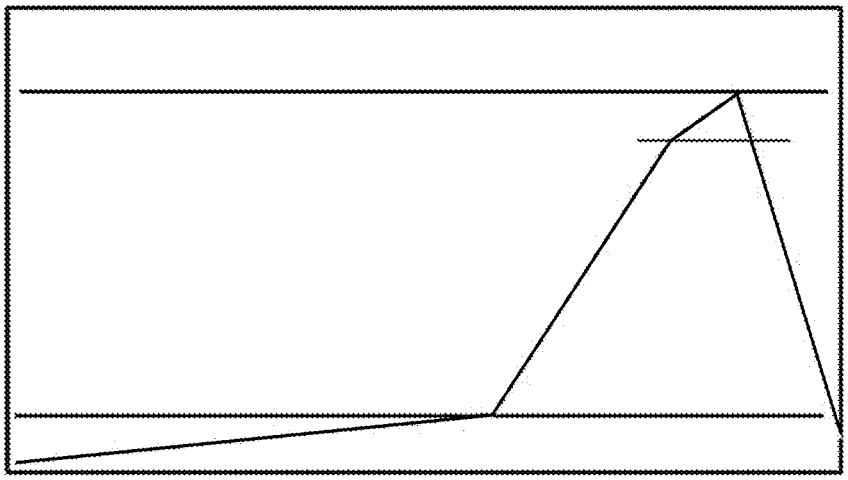
FIG. 14 illustrates a torque profile to be applied to a downhole asset, according to some embodiments of the present disclosure.

Control of the forces and pressure in a torque control system 1310 may allow automated or intelligent control of the torque applied to an asset, which torque profile may be customized to the particular size and/or type of downhole asset. More particularly, the system may electronically or otherwise control or limit the pressure to cylinders during a make-up process. The pressure affects the fill rate of the torque cylinders, thereby affecting the time or profile in building the desired torque. At the target torque, the pressure to the torque cylinders can be removed. As shown in FIG. 14, which represents a control valve profile with torque on the y-axis and time on the x-axis, the pressure may cause torque to raise from virtually no torque to a first, lower target. In some embodiments, the control of the torque may begin at the lower target; however, in other embodiments the torque control may begin at other times, including from the beginning of loading. The lower, full width horizontal line may represent the lower target. A target or maximum desired torque may be represented by the second, higher, full-width horizontal line. When the torque control begins, pressure can be applied to cause the torque to rise along a linear, curved, or other path (or combination of multiple linear, curved, or other paths) to reach the target torque. At the target torque, the pressure can be released, resulting in the torque falling. If the line was to go over the target torque, the downhole asset could become over-torqued. In some embodiments, an alarm or notification may be triggered if an over-torque occurs (or if over-torque exceeds another threshold level or duration).

The torque profile in FIG. 14 is merely illustrative, and may be varied in any number of manners. For instance, the amount of torque applied can vary based on the asset. Similarly, the amount of time used to reach an intermediate or target torque, the length of time maintaining a target torque, and the like, may be varied in different embodiments to obtain a desired torque profile.

Optionally, the torque control system 1310 of FIG. 13 may include a fail safe mode. For instance, control valves that control pressure in a cylinder (and thus torque to a downhole asset) may be configured to operate to control the system only when energized. In an example scenario, if power is lost to the system, the torque application device may revert to a manual or normal control. Similarly, a driller or other operator could disconnect or disable automated/ intelligent control to revert to manual control at any time. In some embodiment, torque sensors in the system may be used to verify torque. Optional torque sensors can include, among other things, pressure sensors and/or pin style load cells. Torque control may also be performed by using a hydraulic control valve, system, or circuit with an on/off release. In the same or other embodiments, an electrically controlled proportional valve (e.g., a PWM proportional valve (or on/off release mechanism)) may be used by the torque control system 1310.

In some embodiments, in addition to managing the torque pressure profile, a hydraulic circuit or other control mechanism can be used to manage the clamping force applied to the downhole asset. In some prior systems, the clamping force may be constant and may not take into consideration features such as the asset size, asset wall thickness, asset material, asset type, or the torque profile for the asset. As a result, clamping force may be higher than desired for some assets, which can result in marking or damage to the assets. To limit such marking or damage, and for any number of other reasons, the torque control system 1310 may further control the amount of clamping force on an asset. In general, a downhole asset with lower torque applied may also be held by a lower clamping force. Optionally, when clamping force is automated, the clamping force, torque values, and grip design may be used to resolve the marking and damage of pipes due to clamping.

In some example embodiments, clamping force may be at least partially controlled by a make line (e.g., leading to $P_1$ in FIG. 13). The make line, for instance, may have a set pressure (e.g., 2,100 psi or 14.5 MPa). In a manual operating mode, the same set pressure may be used for all assets, of all sizes, types, and wall thicknesses. During a well operation, there are many sizes and types of assets that can use drastically different torques. For instance, a small drill pipe that may have a target torque of 10,000 ft-lbs (13,500 N-m) while a large, heavy drill collar may have a target torque of 40,000 ft-lbs (54,000 N-m). To optimize the torque profile and limit or prevent damage/marking of assets, this make pressure may be controlled by the torque control system 1310. For instance, a proportional valve may be used to adjust the make pressure line based on the torque setting. This may be applied in automated/intelligent torque systems, or even for manual systems. In such embodiments, the driller (whether a person or device) can set a torque, and the make pressure to control the clamping force can be proportionally adjusted.

In some embodiments, a torque application device (e.g., an iron roughneck) may include knurled rollers and/or clamp pads to grip the assets being torqued. Optionally, these components may be replaced by dynamically variant clamping pads that adjust themselves to the size of the downhole asset to achieve a minimum area of contact. In some existing systems, clamp pads may be flat or planar, which may not efficiently grip a curved asset. In contrast, the torque control system 1310 may optionally include curved pads, which can increase gripping efficiency, as well as facilitate accurate control of the clamping force. A clamping system, in some embodiments, can maximize surface contact to distribute clamping force over a larger contact area (i.e., to minimize point loading and contact pressure)

Figure 15:
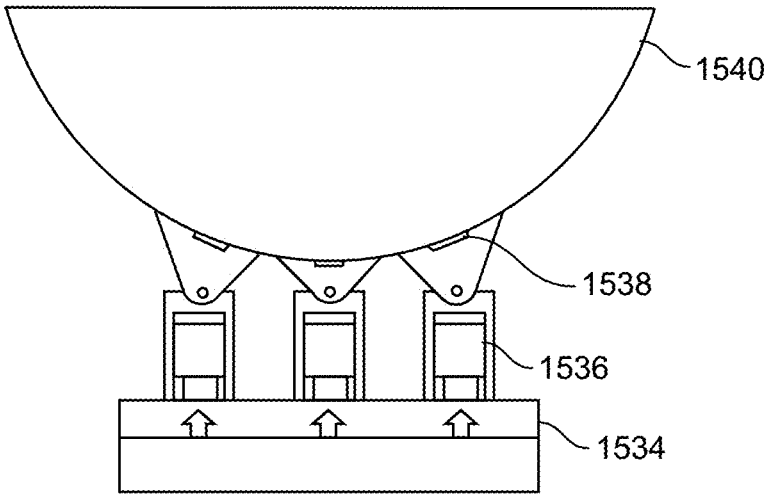
FIG. 15 schematically illustrates a system for adjusting the clamping force on a downhole asset, according to some embodiments of the present disclosure.

FIG. 15, for instance, schematically illustrates an example clamping system, and in some embodiments can be used to automate the clamping force based on asset diameter. As asset diameter decreases, for instance, a base 1534 can move and, in turn, the clamp can adjust position on the asset 1540. The base 1534 and pistons 1536 of a piston mechanism can use incompressible hydraulic fluid, which can equalize across the pistons 1536. A flexible movement of clamping pads 1538 may therefore be achieved.

Existing pad designs may include teeth on knurled rollers, which can create impressions on the assets which are in line with the flow direction. Flow through the assets can erode material in a similar direction, thereby weakening the asset. These teeth or knurls can be replaced, in some embodiments of the present disclosure, by pads with protrusions that have a built-in roughened surface profile that can tend to hold a grip on the asset by friction. These protrusions can also limit or even prevent slipping and modification of the software or control systems. If a slipping coefficient increases (i.e., friction coefficient decreases), a notification can be made for service to allow replacement, repair, or servicing of the clamping pads 1538. Materials with high coefficient of friction can also be considered while making the clamping pads 1538 similar to, for example, low steel pads or non-asbestos organic pads in automotive brake systems.

Figure 16:
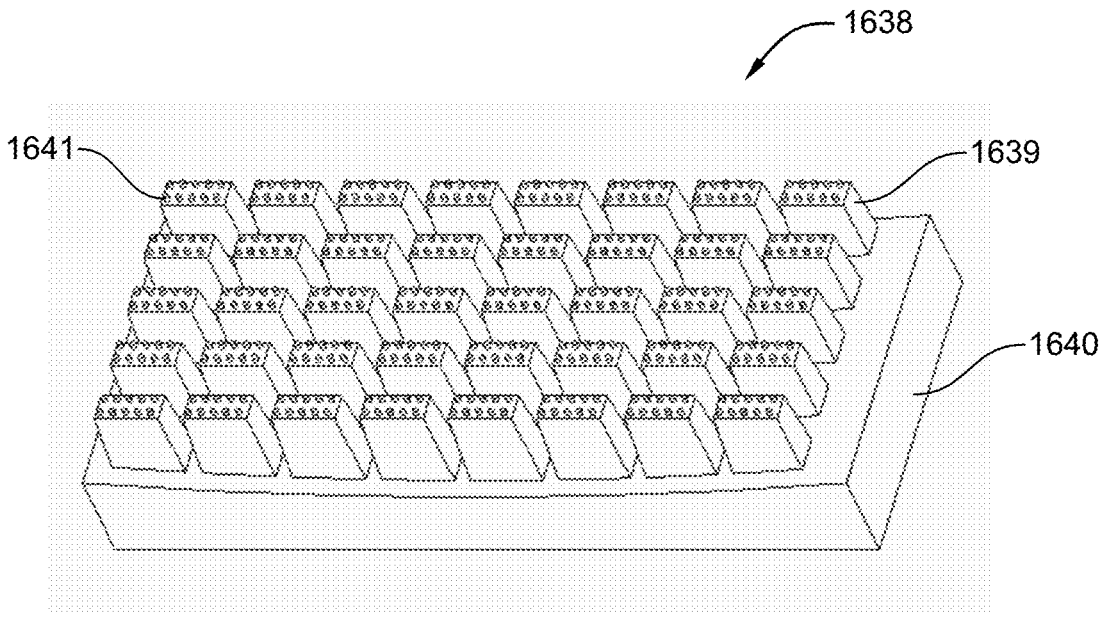
FIGS. 16 and 17 illustrate example clamping pads for use with a torque application device, according to some embodiments of the present disclosure.
Figure 17:
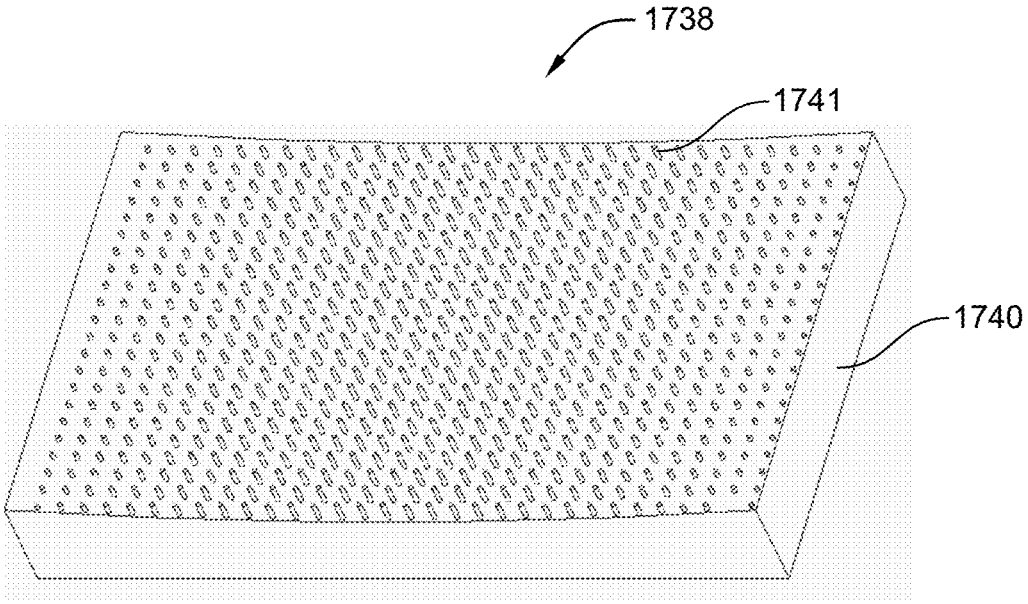

FIGS. 16 and 17 illustrate example clamping pads 1638, 1738 in accordance with some embodiments of the present disclosure. As shown in FIG. 16, for instance, the clamping pad 1638 may include teeth 1639 with a roughened surface profile/material to provide surface features 1641 to enhance grip strength. The base 1640 of the pad 1638 may also be curved (e.g., concavely curved rather than convexly curved like a roller), and the teeth 1639 may have a constant height, to provide a curved contact surface for a downhole asset. In other embodiments, however, the base 1640 may be planar and the teeth 1639 may have different heights to provide a curved or variable contact surface. In other embodiments, the base 1640 and teeth 1639 may both be variable or may both be constant.

In FIG. 17, rather than using teeth, the roughened surface profile of a pad 1738 may be built into a base 1740 itself Surface features such as protrusions 1741 may extend from the base 1740 for use in enhancing grip strength. In some embodiments, the base 1740 may be curved to create a curved contact surface. In such an embodiment, each protrusion 1741 may have the same height. In other embodiments, however, such as that shown in FIG. 17, the protrusions 1741 may have variable heights. The variable heights of the protrusions 1741 may, in combination with the variable or fixed height of the base 1740, may be used to provide a curved, contoured, or even flat contact surface. In at least some embodiments, the spacing between protrusions 1741 may be constant, or may vary. For instance, the spacing may vary such that protrusion density can vary. In the illustrated embodiment, for instance, the protrusion density may be higher toward the center of the pad 1738 (left-to-right in the illustrated orientation), and lower toward the illustrated outer edges (left and right edges in FIG. 17) of the pad 1738. In some embodiments, the protrusion density may be varied in other manners. For instance, the protrusion density may also, or otherwise, vary from top to bottom in the illustrated orientation, vary in a curved or undulating pattern, or otherwise vary.

According to some embodiments of the present disclosure, pressure values and actual, measured clamping and/or torque forces (in addition to, or instead of, torque values which don't take into account the torque arm) may also be used as maintenance or health indicators. This can allow an asset management system, for instance, to identify or predict issues before they occur. This may further limit or even prevent failures by identifying the failures before they occur, thereby changing downtime into scheduled maintenance events.

More generally, embodiments of the present disclosure may allow applying torque to connections on a drill string to rated values without operator interaction, or with reduced operator interaction. This may be performed by, for instance, detecting tool types/sizes being coupled together. RFID or other encoded markers, acoustic sensors, and the like may be used to perform the detection. Once the tool is detected, an automated torqueing system may be used to obtain a torque rating and profile for the tools and connections, and then verify that torque is applied as per the rated value. This type of system may be used to increase the speed at which connections are made-up and to reduce or even eliminate manual errors that occur in reading pressure dials, applying torque, and the like. Additionally, information related to clamping/torque of the tools may be logged on the tools themselves and/or in a data store for later review and/or analysis. If an entire BAH configuration is fed into the system, the configuration of the BAH may also be verified as tools are identified and made-up. In some embodiments, the automated control may be provided as a package to rig operators where they can upload a BAH configuration to a software or other similar package. The system may then verify the BAH configuration on make-up, apply specified torque levels and profiles, and provide alerts if the wrong tools or torque levels are used.

Embodiments of the present disclosure may generally be performed by a computing device or system, and more particularly performed in response to instructions provided by one or more applications or modules executing on one or more computing devices within a system. In other embodiments of the present disclosure, hardware, firmware, software, other programming instructions, or any combination of the foregoing may be used in directing the operation of a computing device or system.

Embodiments of the present disclosure may thus utilize a special purpose or general-purpose computing system including computer hardware, such as, for example, one or more processors and system memory. Embodiments within the scope of the present disclosure also include physical and other computer-readable media for carrying or storing computer-executable instructions and/or data structures, including applications, tables, data, libraries, or other modules used to execute particular functions or direct selection or execution of other modules. Such computer-readable media can be any available media that can be accessed by a general purpose or special purpose computer system. Computer-readable media that store computer-executable instructions (or software instructions) are physical storage media. Computer-readable media that carry computer-executable instructions are transmission media. Thus, by way of example, and not limitation, embodiments of the present disclosure can include at least two distinctly different kinds of computer-readable media, namely physical storage media or transmission media. Combinations of physical storage media and transmission media should also be included within the scope of computer-readable media.

Both physical storage media and transmission media may be used temporarily store or carry, software instructions in the form of computer readable program code that allows performance of embodiments of the present disclosure. Physical storage media may further be used to persistently or permanently store such software instructions. Examples of physical storage media include physical memory (e.g., RAM, ROM, EPROM, EEPROM, etc.), optical disk storage (e.g., CD, DVD, HDDVD, Blu-ray, etc.), storage devices (e.g., magnetic disk storage, tape storage, diskette, etc.), flash or other solid-state storage or memory, or any other non-transmission medium which can be used to store program code in the form of computer-executable instructions or data structures and which can be accessed by a general purpose or special purpose computer, whether such program code is stored as or in software, hardware, firmware, or combinations thereof.

A "network" or "communications network" may generally be defined as one or more data links that enable the transport of electronic data between computer systems and/or modules, engines, and/or other electronic devices. When information is transferred or provided over a communication network or another communications connection (either hardwired, wireless, or a combination of hardwired or wireless) to a computing device, the computing device properly views the connection as a transmission medium. Transmission media can include a communication network and/or data links, carrier waves, wireless signals, and the like, which can be used to carry desired program or template code means or instructions in the form of computer-executable instructions or data structures and which can be accessed by a general purpose or special purpose computer.

Further, upon reaching various computer system components, program code in the form of computer-executable instructions or data structures can be transferred automatically or manually from transmission media to physical storage media (or vice versa). For example, computer-executable instructions or data structures received over a network or data link can be buffered in memory (e.g., RAM) within a network interface module (NIC), and then eventually transferred to computer system RAM and/or to less volatile physical storage media at a computer system. Thus, it should be understood that physical storage media can be included in computer system components that also (or even primarily) utilize transmission media.

Computer-executable instructions comprise, for example, instructions and data which, when executed at one or more processors, cause a general purpose computer, special purpose computer, or special purpose processing device to perform a certain function or group of functions. The computer-executable instructions may be, for example, binaries, intermediate format instructions such as assembly language, or even source code. Although the subject matter of certain embodiments herein may have been described in language specific to structural features and/or methodological acts, it is to be understood that the subject matter of the present disclosure, is not limited to the described features or acts described herein, nor performance of the described acts or steps by the components described herein. Rather, the described features and acts are disclosed as example forms of implementing the some aspects of the present disclosure.

Those skilled in the art will appreciate in view of the disclosure herein that embodiments of the present disclosure may be practiced in stand-alone or network computing environments with many types of computer system configurations, including, servers, supercomputers, personal computers, desktop computers, laptop computers, message processors, hand-held devices, programmable logic machines, multi-processor systems, microprocessor-based or programmable consumer electronics, network PCs, tablet computing devices, minicomputers, mainframe computers, mobile telephones, PDAs, and the like.

Embodiments may also be practiced in distributed system environments where local and remote computer systems, which are linked (e.g., by hardwired data links, wireless data links, or by a combination of hardwired and wireless data links) through one or more networks, both perform tasks. In a distributed computing environment, program modules may be located in both local and remote computer storage devices.

Although a few example embodiments have been described in detail herein, those skilled in the art will readily appreciate in view of the disclosure herein that many modifications to the example embodiments are possible without materially departing from the disclosure of herein, and that such modifications are intended to be included in the scope of this disclosure. Likewise, while the disclosure herein contains many specifics, these specifics should not be construed as limiting the scope of the disclosure or of any of the appended claims, but merely as providing information pertinent to one or more specific embodiments that may fall within the scope of the disclosure and the appended claims. Any described features from the various embodiments disclosed may be employed in combination. In addition, other embodiments of the present disclosure may also be devised which lie within the scopes of the disclosure and the appended claims. Any additions, deletions, and modifications to the embodiments that fall within the meaning and scopes of the claims are to be embraced by the claims. Acts or components of methods disclosed herein may be performed in any order.

In the claims, means-plus-function clauses are intended to cover the structures described herein as performing the recited function and structural equivalents, as well as equivalent structures. It is the express intention of the applicants not to invoke functional claiming for any limitations of any of the claims herein, except for those in which the claim expressly uses the words "means for" together with an associated function.

Certain embodiments and features may have been described using numerical examples, including sets of numerical upper limits and sets of numerical lower limits. It should be appreciated that ranges including the combination of any two values, e.g., the combination of any lower value with any upper value, the combination of any two lower values, or the combination of any two upper values are contemplated. Certain lower limits, upper limits and ranges may appear in one or more claims below. Any numerical values are "about" or "approximately" the indicated value, and take into account experimental error and variations that would be expected by a person having ordinary skill in the art.

What is claimed is:

1. A method for automatically controlling torque on connections of downhole assets, comprising:

measuring fluid pressure to one or more locations of a hydraulic circuit of a torque application device;

automatically increasing fluid pressure of the one or more locations based on a target torque;

measuring a force applied by the torque application device on a downhole asset, the force being used to directly or indirectly determine torque on the downhole asset; and reducing fluid pressure in response to directly or indirectly determining that the torque on the downhole asset reaches the target torque.

2. The method of claim 1, further comprising:

automatically identifying a geometry, type, or target torque of the downhole asset.

3. The method of claim 1, wherein determining torque on the downhole asset includes determining a torque arm based on a diameter or width of the downhole asset.

4. The method of claim 3, further comprising:

automatically adjusting fluid pressure to control clamping force of the torque application device.

5. A method for automatically controlling torque and clamping force on connections of downhole assets, comprising:

determining a torque arm of the downhole asset by identifying a diameter or width of the downhole asset;

determining a torque profile associated with the downhole asset, the torque profile including a target torque;

applying a torque on the downhole asset according to the torque profile, wherein applying the torque includes increasing fluid pressure to one or more locations of a hydraulic circuit of a torque application device and thereby controlling clamping force on, and rotation of, the downhole asset, wherein the torque is dependent on the determined torque arm and wherein the clamping force is proportional to the torque;

reducing fluid pressure of the one or more locations in response to applying the torque on the downhole asset that reaches the target torque; and monitoring health of the downhole asset in real-time.

6. The method of claim 5, using an RFID reader or optical identification system to automatically identify a geometry, type, or target torque of the downhole asset.

7. The method of claim 5, wherein determining the torque profile and target torque includes determining a type of the downhole asset.

8. The method of claim 5, wherein applying the torque includes reviewing deviations in seal loss or friction.

9. The method of claim 5, wherein applying the torque on the downhole asset includes using a torque application device having concavely curved pads that engage the downhole asset, wherein applying the torque and controlling clamping force on the downhole asset include controlling torque and clamping force as applied through the concavely curved pads.

10. The method of claim 9, wherein the torque application device includes an iron roughneck.

11. The method of claim 5, wherein applying the torque includes controlling a make-up pressure based on the target torque.

12. The method of claim 5, wherein applying the torque includes controlling a break-out pressure based on the target torque.

13. The method of claim 5, further comprising detecting slipping of the downhole asset during torqueing and identifying grip wear or maintenance.

14. The method of claim 5, further comprising using an encoded device reader to identify the target torque, the torque profile, or a type of downhole asset.

15. The method of claim 14, the encoded device reader including an RFID reader.

16. The method of claim 5, wherein applying the torque includes storing applied torque values with associated downhole asset identifiers, in a remote data store, on the downhole asset, or both.

17. The method of claim 5, wherein monitoring health of the downhole asset includes predicting when the asset will wear beyond an allowable threshold.

* * * * *